US008511808B2

(12) United States Patent
Yamaguchi et al.

(10) Patent No.: US 8,511,808 B2
(45) Date of Patent: Aug. 20, 2013

(54) LIQUID-EJECTING RECORDING HEAD AND LIQUID-EJECTING RECORDING APPARATUS

(75) Inventors: Yukuo Yamaguchi, Tokyo (JP); Yutaka Koizumi, Yokohama (JP); Mikiya Umeyama, Tokyo (JP); Kiyomitsu Kudo, Machida (JP); Masaru Iketani, Atsugi (JP); Yuichiro Akama, Kawasaki (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1052 days.

(21) Appl. No.: 12/098,861

(22) Filed: Apr. 7, 2008

(65) Prior Publication Data

US 2008/0259115 A1 Oct. 23, 2008

(30) Foreign Application Priority Data

Apr. 20, 2007 (JP) ..... 2007-111779

(51) Int. Cl.
*B41J 2/175* (2006.01)
*B41J 2/165* (2006.01)
*B41J 2/17* (2006.01)

(52) U.S. Cl.
USPC ..... 347/93; 347/31; 347/34; 347/84

(58) Field of Classification Search
USPC ..... 347/30, 31, 34, 41, 84–86, 92, 93, 347/95
See application file for complete search history.

(56) References Cited

U.S. PATENT DOCUMENTS

| | | | | |
|---|---|---|---|---|
| 6,095,633 | A * | 8/2000 | Harshbarger et al. | 347/30 |
| 6,814,435 | B1 * | 11/2004 | Shimada et al. | 347/93 |
| 2005/0117000 | A1 * | 6/2005 | Shimizu | 347/85 |
| 2005/0117005 | A1 * | 6/2005 | Fujii et al. | 347/92 |
| 2005/0219309 | A1 * | 10/2005 | Uchida | 347/30 |

* cited by examiner

*Primary Examiner* — Charlie Peng
*Assistant Examiner* — Hung Lam
(74) *Attorney, Agent, or Firm* — Canon USA, Inc., IP Division

(57) ABSTRACT

A recording head includes a plurality of nozzle arrays separately provided so as to correspond to kinds of recording liquids to be discharged, a plurality of common liquid chambers from which the recording liquids are supplied to the nozzle arrays, a plurality of recording-liquid introducing passages communicating with the common liquid chambers, and a plurality of filters provided in the recording-liquid introducing passages. Upstream aperture areas of the filters are equal to each other, and downstream aperture areas of the filters are different according to the kinds of recording liquids passing through the filters.

9 Claims, 15 Drawing Sheets

LIQUID-EJECTING RECORDING HEAD AND LIQUID-EJECTING RECORDING APPARATUS

BACKGROUND OF THE INVENTION

1. Field of the Invention

The present invention relates to a liquid-ejecting recording head including nozzle arrays that apply recording liquid onto a recording medium, and to a liquid-ejecting recording apparatus in which the liquid-ejecting recording head is mounted. The present invention can be applied to a liquid-ejecting recording head including nozzle arrays that apply recording liquid onto a recording medium, and to a liquid-ejecting recording apparatus in which the liquid-ejecting recording head is mounted. Further, the present invention can be applied to a liquid-ejecting recording head including nozzle arrays that are scanned in two directions so that a recording liquid of a specific color is applied in a symmetrical order with respect to a recording liquid of another color, and to a liquid-ejecting recording apparatus in which the liquid-ejecting recording head is mounted.

2. Description of the Related Art

Image forming apparatuses record images on a recording medium, such as a paper sheet or a thin plastic plate, according to image information (including character information). Image forming apparatuses are classified, for example, into a liquid ejection type, a wire dot type, a thermal type, and a laser beam type by recording method. Among these types, the liquid-ejection type image forming apparatus performs recording by discharging droplets of recording liquid from a liquid-ejecting recording head (hereinafter sometimes abbreviated as a recording head) onto a recording medium. In the liquid-ejection type image forming apparatus, size reduction of the recording means is easy, high-speed recording of high-definition images is possible, and the operating cost is low. Since recording is performed in a non-impact manner, the noise level is low. In addition, a color image can be easily recorded with recording liquids of multiple colors.

In general, bubbles are formed in a recording-liquid flow passage, a common liquid chamber, and a discharging-energy generating chamber provided in a recording head. Bubbles are formed by printing or suction recovery, or formed when the recording head is left unused for a long time. These bubbles may form a lump of bubble, which can hinder the supply of recording liquid and induce a non-discharging phenomenon of recording liquid. The lump of bubble in the recording head is sucked and removed by a suction recovery unit provided in the main body of the liquid-ejecting recording apparatus.

The suction recovery unit instantaneously generates a high negative pressure, separates bubbles from walls of a recording-liquid flow passage, a common liquid chamber, and a discharging-energy generating chamber, and applies suction to remove the bubbles together with the recording liquid. However, if suction is performed with a low negative pressure of suction, bubbles are not sufficiently removed from the recording head.

The low negative pressure of suction refers to a negative pressure such as not to draw in bubbles from a recording-liquid storage tank that includes an absorber for holding recording liquid. In contrast, when suction is performed with a high negative pressure of suction, the balance between the recording-liquid holding force (capillary force) of the absorber and the negative pressure of suction is disrupted. As a result, bubbles are drawn in together with the recording liquid from the recording-liquid storage tank. These new bubbles drawn in the recording head induce a non-discharging phenomenon of recording liquid.

In this way, it is important to control the negative pressure in the suction recovery operation. This suction recovery operation allows the liquid-ejecting recording apparatus to always stably discharge the recording liquid.

Suction recovery using the suction recovery unit is performed while all nozzle arrays are covered with a cap or while a plurality of groups of nozzle arrays are covered with the respective caps. In general, a plurality of nozzle arrays provided in the same member are capped collectively.

In any case, a suction may be applied to the recording head while a cap formed of an elastic material, such as rubber, is in tight contact with the peripheries of the nozzles. As a result, different kinds of recording liquids may be removed simultaneously from the recording head by applying suction thereto. Further, suction recovery is performed by reducing the pressure in the cap by a suction pump.

Unfortunately, if the relative difference in flow resistance (flow resistance ratio) among the recording-liquid flow passages increases, the balance of suction amount among the recording-liquid flow passages is disrupted, and it is difficult to collectively subject all the nozzles to suction recovery. Examples of recording heads in which the flow resistance ratio of the recording-liquid flow passages is high will be given below.

(1) A recording head having a nozzle layout in which nozzle arrays corresponding to specific recording liquids are symmetrically arranged with respect to a nozzle array corresponding to another recording liquid (hereinafter referred to as "symmetrically arranged nozzle arrays"). In general, cyan and magenta recording liquids are defined as the specific recording liquids. A recording-liquid flow passage communicating with each of the symmetrically arranged nozzle arrays is bifurcated. That is, the number of nozzles included in each of the symmetrically arranged nozzle arrays is about double the number of nozzles included in another nozzle array that is not symmetrically arranged (hereinafter referred to as a "single nozzle array"). For this reason, the flow resistance in the recording-liquid flow passages communicating with the symmetrically arranged nozzle arrays is lower than the flow resistance in the recording-liquid flow passage communicating with the single nozzle array. Therefore, the amount of recording liquid to be sucked from each of the symmetrically arranged nozzle arrays is larger than that of the single nozzle array.

(2) A recording head in which a nozzle array corresponding to a specific recording liquid includes nozzles having a large diameter (large nozzles) and nozzles having a small diameter (small nozzles) (hereinafter refereed to as a "large and small nozzle array"), and a nozzle array corresponding to another recording liquid includes only large nozzles (hereinafter referred to as a "large nozzle array"). However, the total number of large and small nozzle arrays is substantially equal to the total number of large nozzle arrays. For this reason, the flow resistance in a recording-liquid flow passage communicating with the large nozzle array is lower than the flow resistance in a recording-liquid flow passage communicating with the large and small nozzle array. Therefore, the amount of recording liquid to be sucked from the large nozzle array is larger than that of the large and small nozzle array.

(3) A recording head in which symmetrically arranged nozzle arrays each include large nozzles and small nozzles, and a single nozzle array includes only large nozzles. In this case, the flow resistance in recording-liquid flow passages communicating with the symmetrically arranged nozzle arrays is higher than the flow resistance in a recording-liquid flow passage communicating with the single nozzle array. However, the difference in flow resistance between the nozzle arrays is smaller than in the above-described recording head (1).

(4) A recording head including a nozzle array having only small nozzles and a nozzle array having only large nozzles. In this case, the flow resistance in a recording-liquid flow passage communicating with the nozzle array having only large nozzles is lower than the flow resistance in a recording-liquid flow passage communicating with the nozzle array having only small nozzles.

In recent liquid-ejecting recording apparatuses, enhancement of recording quality and increase of the recording speed in color printing are important themes. A high-quality image can be recorded in many gradation levels by discharging recording-liquid droplets onto a recording medium so as to form dots having different areas.

In a typical recording head, two nozzle arrays extend in parallel and in a direction orthogonal to a head scanning direction. In normal cases, one of the nozzle arrays is a large nozzle array, and the other nozzle array is a small nozzle array. The large nozzle array and the small nozzle array communicate with a common recording-liquid supply port so that the same kind of recording liquid is supplied to the nozzle arrays. That is, recording-liquid droplets are discharged onto the recording medium to form dots having different areas by dot modulation that allows large droplets and small droplets to be discharged selectively.

FIG. 14A is a schematic plan view showing the surroundings of a liquid-ejecting section in a recording head having the above-described configuration as the related art. A plurality of nozzle passages 403 and a plurality of energy generating elements 404 are provided on a substrate 402. Nozzles 411 and 412 are provided so as to oppose the energy generating elements 404. An orifice plate 410 is joined to the substrate 402, as shown in FIG. 14B serving as a cross-sectional view taken along line XIVB-XIVB in FIG. 14A.

The nozzles 411 form an array, and the nozzles 412 form another array. The diameter of the nozzles 411 is different from that of the nozzles 412. Correspondingly, the area of regions in which the energy generating elements 404 apply energy to the recording liquid is different between the arrays of the nozzles 411 and 412. The width of the nozzle passages 403 is also different between the arrays of the nozzles 411 and 412. More specifically, the diameter of the nozzles, the areas of the energy generating elements 404, and the width of the nozzle passages 404 in the right array of the nozzles 411 are larger than in the left array of the nozzles 412. Therefore, the volume of droplets of recording liquid discharged from the nozzles 411 in the left array is smaller than the volume of droplets of recording liquid discharged from the nozzles 412 in the right array. As a result, it is possible to discharge two kinds of recording-liquid droplets having different volumes.

Accordingly, recording can be performed in more gradation levels than when the recording head discharges only recording-liquid droplets having a large volume. Moreover, recording can be performed at a higher speed than when the recording head discharges only recording-liquid droplets having a small volume. Since the ratio of the large droplets and the small droplets can be freely determined, one recording head can have a wide range of recording characteristics.

In order to maintain high image quality, it is necessary to prevent the entry of foreign substances that adversely affect discharging by the recording head. This is because print quality is reduced when the nozzles and flow passages are clogged with foreign substances or dust. Accordingly, a porous member (filter) is provided in a recording-liquid introducing portion of a typical recording head. The filter needs to trap foreign substances and dust smaller than the diameter of nozzles and the size of flow passages. That is, the required trap ability of the porous member is determined by the diameter of nozzles and the size of flow passages. The ability is generally expressed as mesh roughness.

The flow resistance of the entire recording head is substantially determined by the pressure losses in the nozzles 411 and 412, the nozzle passages 403, and the filter. That is, enhancing the trapping ability of the filter means increasing the flow resistance of the entire recording-liquid supply passage.

FIG. 15 is an external perspective view of the recording head as the related art. FIGS. 16A to 16C are partial cross-sectional views showing the cross-sectional shape of a recording-liquid introducing portion in the recording head. FIG. 16A shows a state before the filter is fixed, FIG. 16B shows a state immediately after the filter is welded, and FIG. 16C shows a state in which the filter is in contact with a press contact member.

Referring to FIG. 15, the recording head includes recording element substrates 200, a first plate 201 serving as a support substrate, a sheet electric wiring board 202, a contact-terminal wiring board 203, a second plate 204, a flow passage forming member 205, and screws 206.

As shown in FIGS. 16A to 16C, a filter 207 is fixed to a recording-liquid introducing portion 210 provided in the flow passage forming member 205 by heat welding. The recording-liquid introducing portion 210 includes a welding rib 211 that welds the filter 207, and a covering rib 212 that covers the edge of the filter 207 from the periphery. These ribs 211 and 212 fix the filter 207. A plurality of columns 213 stand at the back of the filter 207 so as to support the filter 207. A press contact member 220 is provided in a recording-liquid supply portion of a recording-liquid storage tank (not shown). By contact between the filter 207 and the press contact member 220, recording liquid is supplied (FIG. 16C). In this case, it is necessary to reliably attach the filter 207 so that a fiber edge around the filter 207 does not scratch the press contact member 220 and the filter 207 does not separate. For that purpose, the edge of the filter 207 is prevented from being exposed by being covered with resin of the flow passage forming member 205 (see U.S. Pat. No. 6,592,215).

In order to ensure proper contact between the filter 207 and the press contact member 220, it is necessary to appropriately set the shape of the contact portion, the relative positional accuracy, and the contact pressure. For purposes of proper contact and stable production, it is effective to form the filter 207 in the shape of a perfect circle.

The recording-liquid introducing portion 210 and the filter 207 are provided for each of the mounted recording-liquid storage tanks. While the filter 207 has a small diameter of several millimeters, the material cost thereof is high. Accordingly, lower production cost and higher productivity are achieved by using the same type of filters.

The following methods are effective in increasing the recording speed of the liquid-ejecting recording apparatus: (1) The length of the nozzle arrays in the recording head is increased. (2) The discharging (driving) frequency of the recording head is increased. (3) The number of printing passes is reduced, for example, by bidirectional printing.

In bidirectional printing, the energy needed to obtain the same throughput is dispersed in time, when compared with unidirectional printing. Therefore, bidirectional printing is markedly effective in terms of the cost of the total system.

Unfortunately, in bidirectional printing, the landing order of color ink droplets differs between the forward scanning direction and the backward scanning direction of the recording head. This causes a principle problem of band-shaped color unevenness. Since this problem results from the landing order of the recording liquid droplets, it appears more or less as a difference in color development when different color dots overlap with each other.

More specifically, recording liquid discharged earlier first dyes the recording medium from the surface to the inside so as to form a dot thereon. The subsequent recording liquid forms a dot so that the dot overlaps with the dot formed by the preceding recording liquid. Then, much recording liquid dyes a portion under the portion dyed by the preceding recording liquid. Therefore, the color of the preceding recording liquid tends to develops more. For this reason, when discharging nozzle arrays corresponding to different colors are arranged in order in the main scanning direction, band-shaped color unevenness occurs. That is, in bidirectional printing, the landing order of droplets of recording liquid is reversed between the forward scanning direction and the sub-scanning direction. As a result, band-shaped color unevenness is caused by the difference in color development.

Accordingly, there has been adopted a recording head in which recording liquids of specific colors (for example, cyan and magenta) are discharged in a symmetrical order with respect to another color. By adopting this recording head, cyan and magenta recording liquids can be discharged in the same order during bidirectional printing.

In recent developments of the recording head for higher recording speed and higher recording quality, not only the length of the nozzle arrays has been increased, but also nozzles having different diameters have been provided so as to correspond to the colors of recording liquids. In this recording head, a high trapping ability is required to the porous member. For that purpose, a fine-mesh porous member is adopted. However, this increases the flow resistance in the entire recording-liquid flow passage, and also increases the difficulty in controlling suction recovery in the apparatus body. Moreover, the increase in mesh density increases the cost of the porous member.

On the other hand, the relative difference in flow resistance among the recording-liquid flow passages increases, and the balance of the suction amount is disturbed. Consequently, it is difficult to simultaneously apply suction to a plurality of nozzle arrays by covering the nozzle arrays with a single cap.

More specifically, when a suction is applied to the nozzle arrays simultaneously, the suction amount from the recording-liquid flow passage having a low flow resistance is larger than the suction amount from the recording-liquid flow passage having a high flow resistance. In this way, when suction is conducted, with a great negative pressure, on the head in which the flow resistance is out of balance among the recording-liquid flow passages, the number of bubbles in the head increases. That is, in the flow passage having a low flow resistance, the supply amount of the recording-liquid storage tank increases, and bubbles are drawn into the flow passage together with the recording liquid. In contrast, in the flow passage having a high flow resistance, bubbles remaining in the flow passage are not sufficiently ejected because of a shortage of negative pressure of suction. The above-described problems become more remarkable as the relative difference in flow resistance between the recording-liquid flow passages increases. As a result, the number of bubbles remaining in the recording head increase.

With the increase of the relative difference in flow resistance between the recording-liquid flow passages, an amount of ink (recording liquid) wasted during a suction recovery process may be increased, thereby increasing an operating cost associated therewith.

SUMMARY OF THE INVENTION

An embodiment of the present invention provides a recording head which reduces a difference in flow resistance between a plurality of nozzle arrays and in which suction recovery can be performed while a plurality of nozzle arrays for discharging different kinds of recording liquids are covered collectively.

An embodiment of the present invention is configured to reduce an amount of ink (recording liquid) wasted during a suction recovery process, thereby reducing an operating cost associated therewith.

A recording head according to an aspect of the present invention includes a plurality of nozzle arrays separately provided so as to correspond to kinds of recording liquids to be discharged; a plurality of common liquid chambers from which the recording liquids are supplied to the nozzle arrays; a plurality of recording-liquid introducing passages communicating with the common liquid chambers; and a plurality of porous members provided in the recording-liquid introducing passages and configured to trap dust and a bubble in the recording liquids. The upstream aperture areas of the porous members are equal to each other, and the downstream aperture areas of the porous members vary according to the kinds of the recording liquids flowing through the porous members.

A recording head according to another aspect of the present invention includes a plurality of nozzle arrays separately so as to correspond to kinds of recording liquids to be discharged; a plurality of common liquid chambers from which the recording liquids are supplied to the nozzle arrays; a plurality of recording-liquid introducing passages communicating with the common liquid chambers; and a plurality of porous members provided in the recording-liquid introducing passages and configured to trap dust and a bubble in the recording liquids. The upstream aperture areas of the porous members are equal to each other, and the downstream aperture areas of the porous members vary according to relative differences in flow resistance between recording-liquid flow passages extending from the porous members to the nozzle arrays communicating with the porous members.

A recording head according to a further aspect of the present invention includes a first nozzle array group in which nozzle arrays for discharging a recording liquid of a specific color, of recording liquids of a plurality of colors, are symmetrically arranged with respect to a nozzle array for discharging a recording liquid of a color different from the specific color; a second nozzle array group including a nozzle array for discharging a recording liquid of a color different from the plurality of colors; a plurality of common liquid chambers from which the recording liquids are supplied to the nozzle arrays; a plurality of recording-liquid introducing passages communicating with the common liquid chambers; and a plurality of porous members provided in the recording-liquid introducing passages and configured to trap dust and a bubble in the recording liquids. The upstream apertures areas of the porous members are equal to each other. The downstream aperture areas of the porous members communicating with the nozzle arrays in the first nozzle array group are smaller than the downstream aperture area of the porous member communicating with the nozzle array in the second nozzle array.

A recording head according to a further aspect of the present invention includes a first nozzle array group in which nozzle arrays including a plurality of nozzle arrays of nozzles having different sizes; a second nozzle array group including a nozzle array of nozzles having the same size as that of the largest nozzles in the nozzle arrays of the first nozzle array group; a plurality of common liquid chambers from which recording liquid is supplied to the nozzle arrays; a plurality of recording-liquid introducing passages communicating with the common liquid chambers; and a plurality of porous members provided in the recording-liquid introducing passages and configured to trap dust and a bubble in the recording liquid. The upstream aperture areas of the porous members are equal to each other. The downstream aperture areas of the porous members communicating with the nozzle arrays in the first nozzle array group are smaller than the downstream aperture area of the porous member communicating with the nozzle array in the second nozzle array.

A recording apparatus according to a further aspect of the present invention includes any of the above-described recording heads; and a suction recovery unit configured to apply suction to remove a bubble from the recording head. The suction recovery unit collectively covers at least two nozzle arrays configured to discharge different kinds of recording liquids and simultaneously apply suction to the at least two nozzle arrays.

According to an aspect of an embodiment of the present invention, a difference in flow resistance between a plurality of nozzle arrays is reduced. Therefore, a plurality of nozzle arrays for discharging different kinds of recording liquids are easily and collectively covered and subjected to suction recovery. Further, an amount of ink (recording liquid) wasted during a suction recovery process is reduced, and an operating cost associated therewith is thereby reduced.

Further features of the present invention will become apparent from the following description of exemplary embodiments with reference to the attached drawings.

DESCRIPTION OF THE EMBODIMENTS

First Exemplary Embodiment

A first exemplary embodiment of the present invention will be described in detail below with reference to FIGS. 1 to 13.

In a recording head according to the first exemplary embodiment, a plurality of nozzle arrays are separately so as to correspond to the kinds of recording liquids to be ejected. More specifically, the nozzle arrays corresponding to the respective colors are symmetrically arranged, as viewed at least in a main scanning direction. Preferably, droplets from the nozzles are caused to land in each pixel on a recording medium so that the orders of landing of the droplets are symmetrical. A color dot containing a mixture of primary colors and secondary colors is formed in each pixel in the following manner. That is, ink of at least one of the primary colors is discharged from the same nozzle during forward scanning and backward scanning. The nozzles corresponding to the remaining primary color are provided in a pair, and are symmetrically arranged in the main scanning direction. This manner can avoid band-shaped color unevenness due to bidirectional printing.

Figure 11A:
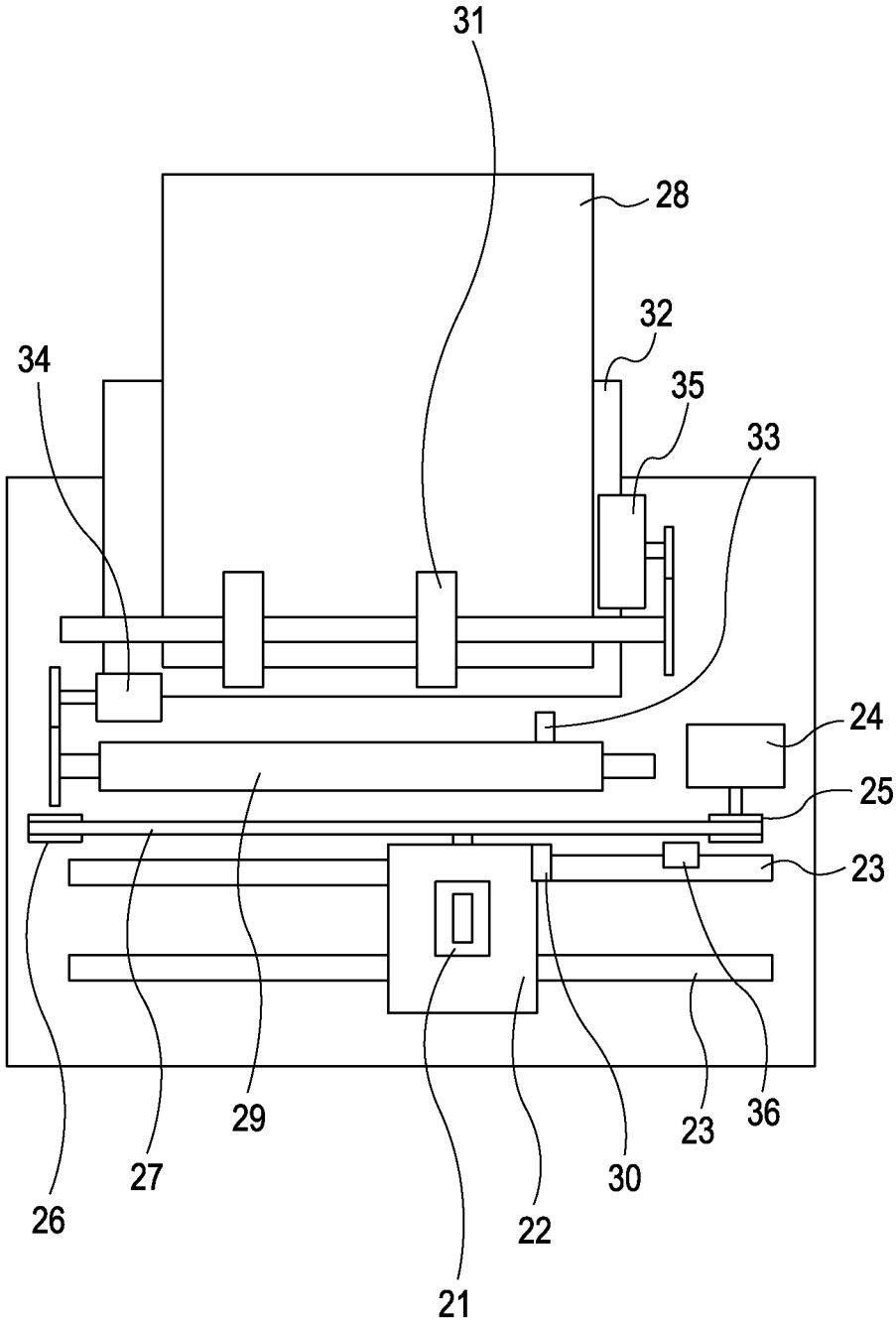
FIGS. 11A and 11B are schematic views showing the principle configuration of a liquid-ejecting recording apparatus.
Figure 11B:
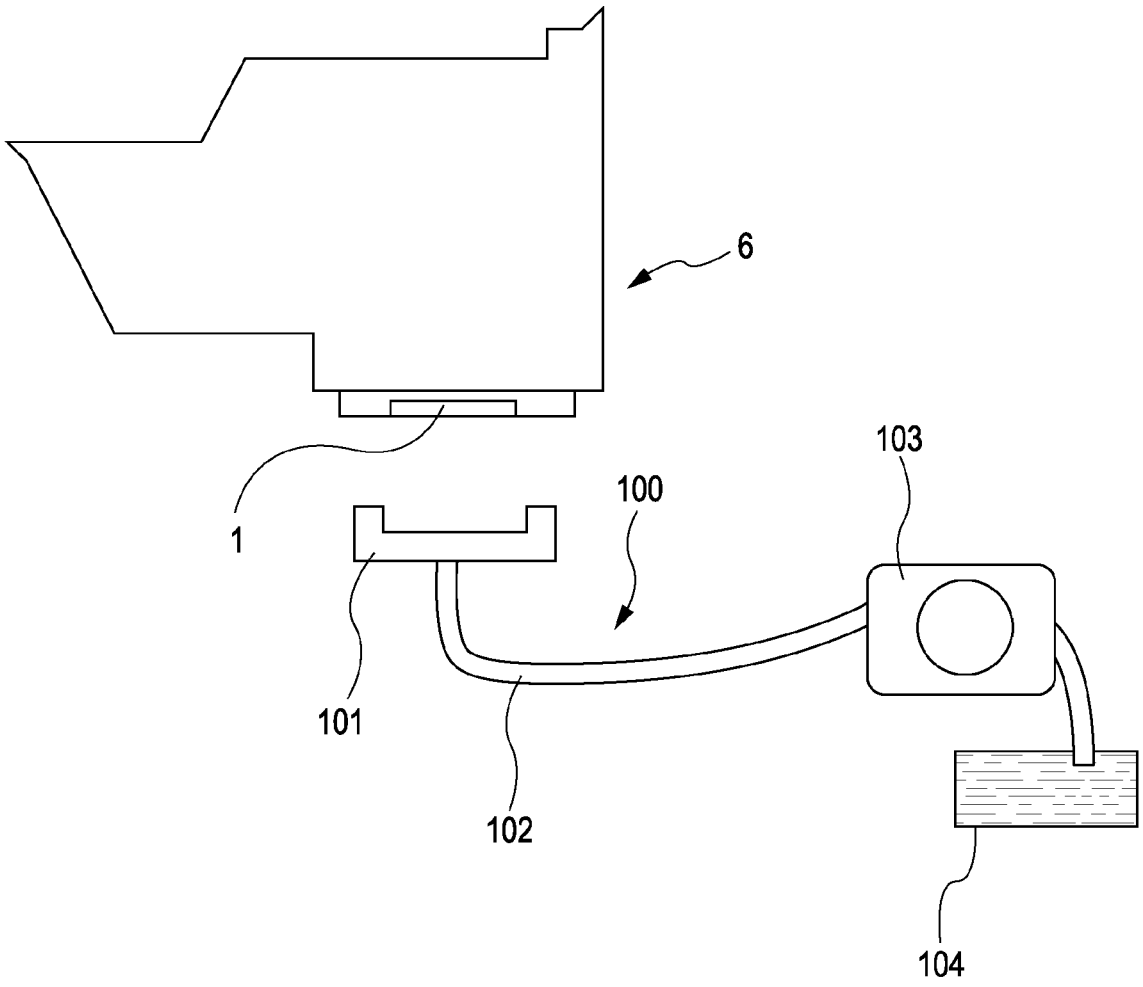

A configuration of a liquid-ejecting recording apparatus according to the first exemplary embodiment will be described first. As shown in FIGS. 11A and 11B, a liquid-ejecting recording head 21 (hereinafter referred to as a recording head 21) is interchangeably mounted on a carriage 22. The recording head 21 is provided with a connector that transmits and receives a driving signal for discharging droplets (details will be described below). The carriage 22 is provided with a head contact terminal that transmits a driving signal and so on to the recording head 21 via the connector. The carriage 22 is supported so as to reciprocate along a guide shaft 23 that extends in the main scanning direction in an apparatus body. The carriage 22 is driven by a main-scanning motor 24 via a driving mechanism including a motor pulley 25, a driven pulley 26, and a timing belt 27. The position and motion of the carriage 22 are controlled by the driving mechanism. Further, a home position sensor 30 is provided in the carriage 22. Therefore, it can be determined whether the home position sensor 30 passes a shielding plate 36.

Recording media 28 are separated and fed one by one from an automatic sheet feeder 32 by pickup rollers 31 that are rotated by a sheet feed motor 35. In the following description, the automatic sheet feeder 32 will be referred to as an ASF 32.

A separated and fed recording medium 28 is conveyed (sub-scanned) via a position facing a nozzle surface of the recording head 21 (printing section) by the rotation of a conveying roller 29 that is rotated by an LF motor 34. At the time when the recording medium 28 passes a recording-medium end sensor 33, it is determined whether the recording medium has been fed, and the amount by which the supplied recording medium 28 is conveyed to a registration position by the conveying roller 29 is determined. The recording-medium end sensor 33 also detects a rear end of the recording medium 28. Also, the recording-medium end sensor 33 is used to finally find the present recording position from the actual rear end.

A back surface of the recording medium 28 is supported by a platen (not shown) so that the recording medium 28 forms a flat print surface in the printing section. In this case, the recording head 21 is held so that the nozzle surface thereof protrudes downward from the carriage 22 and is parallel to the recording medium 28 on the downstream side of the conveying roller 29.

Figure 2A:
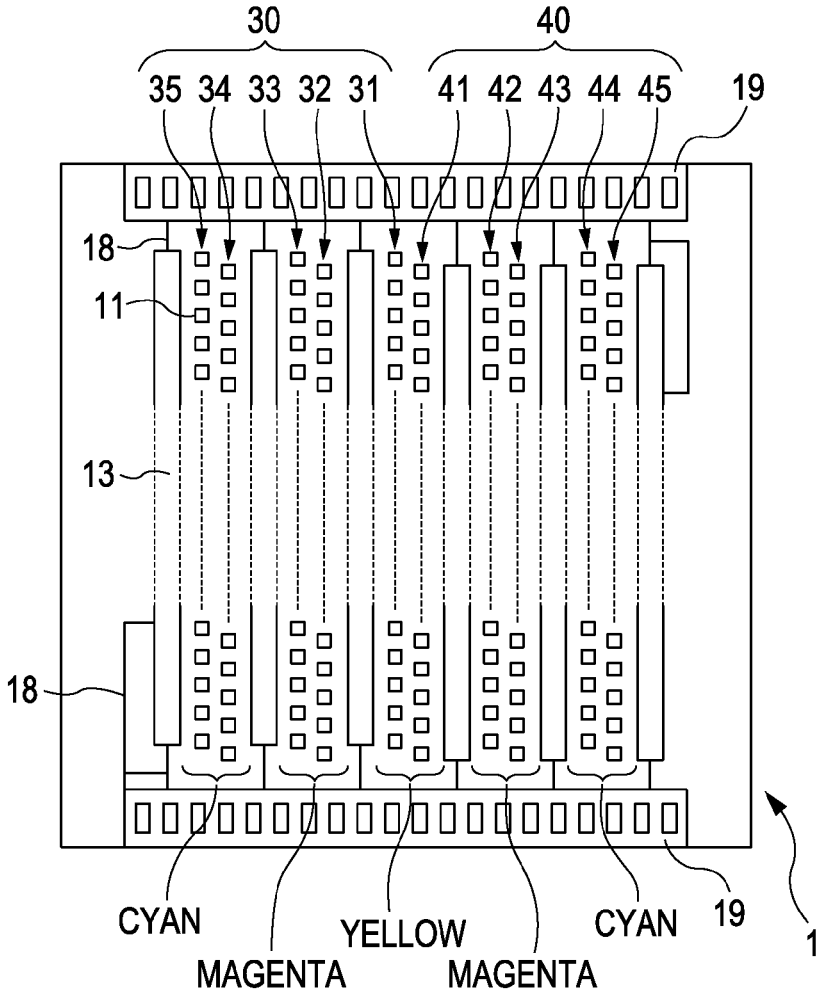
FIG. 2A is a schematic plan view showing the principal part of a color recording element substrate.
Figure 2B:
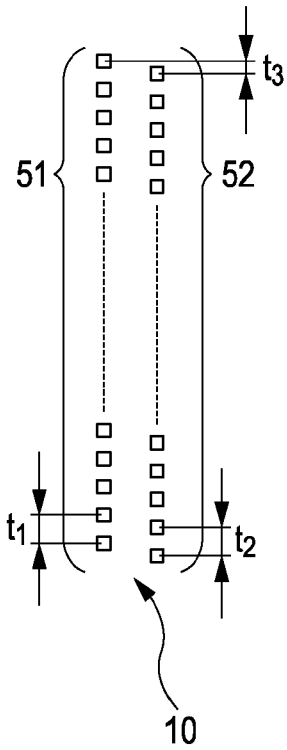
FIG. 2B is a schematic plan view showing the principal part of a black recording element substrate.

The structure of the recording head 21 will now be described. In the first exemplary embodiment, the recording head 21 includes a recording element substrate that applies recording liquids of a plurality of colors onto a recording medium so as to form a secondary color in a secondary color image region, and a recording element substrate that applies a recording liquid of a color different from the plurality of colors onto the recording medium. More specifically, the recording head 21 includes a recording element substrate 1 for three colors of cyan (C), magenta (M), and yellow (Y), and a recording element substrate 10 for black, as shown in FIGS. 2A and 2B. That is, the three color recording liquids C, M, and Y correspond to the above-described recording liquids of a plurality of colors, and the black recording liquid corresponds to the above-described recording liquid of a color different from the plurality of colors.

Figure 2C:
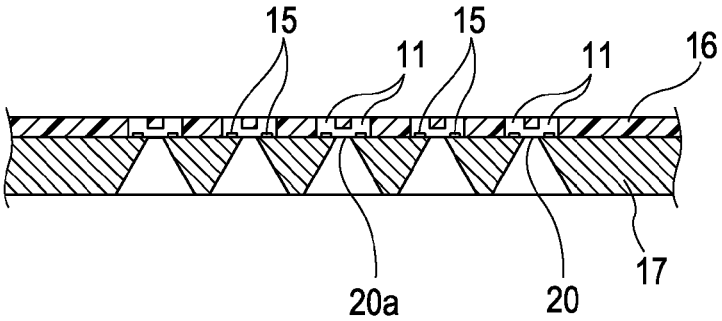
FIG. 2C is a cross-sectional view of the color recording element substrate shown in FIG. 2A.

As schematically shown in FIG. 2C, each of the recording element substrates 1 and 10 includes a base plate 17 having heating resistors 15 serving as energy conversion elements, and an orifice plate 16 that forms nozzles 11 serving as discharging ports. The base plate 17 is formed of a (100)-oriented silicone single crystal. A plurality of lines of heating resistors 15, driving circuits 13 for driving the heating resistors 15, and lines 18 for connecting contact pads 19 are provided on the base plate 17. These components are formed by a semiconductor fabrication process. In a region of the base plate 17 excluding the driving circuits 13, the heating resistors 15, and the lines 18, five through holes are formed by anisotropic etching. These through holes serve as recording-liquid supply ports 20 and 20*a* through which recording liquid is supplied to nozzle arrays 31 to 33 and nozzle arrays 41 to 43 that will be described below. FIG. 2A schematically shows a state in which a substantially transparent orifice plate 16 is provided on the base plate 17. In FIG. 2A, the heating resistors 15 and the recording-liquid supply ports 20 and 20*a* are not shown.

The orifice plate 16 provided on the base plate 17 is formed of a photosensitive epoxy resin. Nozzles 11 are formed in the orifice plate 16 corresponding to the above-described heating resistors 15 by photolithography.

The recording element substrates 1 and 10 utilize the pressure of a bubble produced by film boiling due to the heat energy applied from each heating resistor 15. Recording is performed by discharging droplets of recording liquid from the nozzle 11 by this bubble pressure.

A plurality of nozzles 11 serving as discharging ports are provided in the color recording element substrate 1. The nozzles 11 are arranged at regular intervals so as to form substantially parallel discharging port arrays or nozzle arrays 31 to 35 and 41 to 45. The recording element substrate 1 is mounted and scanned in a liquid-ejecting recording apparatus that will be described below. The nozzle arrays 31 to 35 and the nozzle arrays 41 to 45 are arranged so that the orders of colors corresponding to the nozzle arrays are symmetrical in the scanning direction. Similarly to the nozzle arrays 31 to 33, the nozzle arrays 41 to 45 are arranged. The nozzle arrays 31 to 35 form a first nozzle array group 30, and the nozzle arrays 41 to 45 form a second nozzle array group 40 adjacent to the first nozzle array group 30.

Of the nozzle arrays included in the two nozzle array groups 30 and 40, the nozzle arrays 34, 35, 44, and 45 provided on the outer sides form a third discharging port group for cyan ink serving as a third recording liquid. The center nozzle arrays 31 and 41 form a first discharging port group for yellow ink serving as a first recording liquid. The intermediate nozzle arrays 32, 33, 42, and 43 form a second discharging port group for magenta ink serving as a second recording liquid. For this reason, yellow ink is supplied to the center recording-liquid supply port 20*a*. Further, magenta ink is supplied to the two recording-liquid supply ports 20 adjacent to the recording-liquid supply port 20*a*, and cyan ink is supplied to the two outermost recording-liquid supply ports 20. The color inks are respectively supplied from independent recording-liquid storage tanks to the recording-liquid supply ports 20 and 20*a*.

In short, the nozzle arrays for discharging recording liquids of specific colors (cyan and magenta), of recording liquids of a plurality of colors (cyan, magenta, and yellow) to be applied to form a secondary color, are symmetrically arranged with respect to the nozzle array for discharging a recording liquid of a color (yellow) different from the specific colors. These nozzle arrays form the first nozzle array group 30.

Nozzle arrays 51 and 52 for discharging a recording liquid of a color (black) different from the plurality of colors form a third nozzle array group.

In a portion where the two nozzle array groups 30 and 40 are adjacent to each other, the nozzle arrays 31 and 41 for discharging the same kind of liquid are arranged. With respect to this portion, the other nozzle arrays for discharging the same kind of liquid and the driving circuits for the nozzle arrays are substantially symmetrically arranged. This layout allows the recording-liquid supply ports, the driving circuits, and the heating resistors to be equally spaced on the substrate, and reduces the size of the substrate. When the nozzle arrays for discharging the same kinds of recording liquids are thus arranged in line symmetry, the order in which the recording liquid is discharged in one pixel so as to form a desired color on the recording medium does not differ between forward scanning and backward scanning. Therefore, uniform color development is possible, regardless of the scanning direction, and color unevenness due to bidirectional printing is avoided.

The first nozzle array group 30 and the second nozzle array group 40 are arranged so as to complement each other. That is, the nozzles in the nozzle arrays 31 to 35 are shifted from the nozzles in the nozzle arrays 41 to 45 in the array direction, so that the first and second nozzle array groups 30 and 40 complement each other in the scanning direction. In the first exemplary embodiment, each of the nozzle arrays in the first and second nozzle array groups 30 and 40 includes 128 nozzles. The nozzle pitch t1 (=t2) is about 40 μm (600 dpi). The nozzle array 31 and the nozzle array 41 are staggered by half the pitch (by t3) in the sub-scanning direction of the recording head 21. More specifically, t3 is equal to half of t1, that is, about 20 μm. This allows printing in a high definition mode of 1200 dpi.

In contrast, the nozzle arrays do not need to be symmetrically arranged on the black recording element substrate 10, since black ink is generally used alone. In order to increase the recording speed in monochrome printing, the number of nozzles for black is set to be larger than the number of nozzles for the other colors. The black nozzle arrays 51 and 52 are arranged so that the nozzles complement each other in the scanning direction, similarly to the color nozzle arrays 31 and 41. Therefore, black printing can be performed in the sub-scanning direction in double the array density of the nozzle arrays.

A suction recovery unit (see FIG. 11B) includes a color-only cap for covering and sucking the nozzle surface of the color recording element substrate 1. The suction recovery unit also includes a black-only cap for covering and sucking the black recording element substrate 10.

The structure of the recording head 21 will be more specifically described with reference to FIGS. 3, 4, and 5. Referring to these figures, the recording head 21 includes a first plate 2 serving as a support plate, a sheet electric wiring board 3, a contact-terminal wiring board 4, a second plate 5, a flow passage forming member 6, a porous member (filter) 7, a seal member 8, and screws 9.

The two recording element substrates 1 and 10 are joined on an upper surface of the first plate 2 after the relative positions and the inclinations are aligned. The relative positions of the recording element substrates 1 and 10 and the first plate 2 are precisely determined by a semiconductor mounting technology.

The recording element substrates 1 and 10 do not always need to be formed by two substrates, as shown in the figures, and they may be formed by one substrate, three or more substrates, or a combination of a plurality of recording element substrates having different sizes. These structures are properly used according to the applications.

The first plate 2 is formed of, for example, aluminum, an aluminum alloy, or ceramics. The first plate 2 also serves as a heat radiation member that efficiently radiates heat generated by discharging from the recording element substrates 1 and 10.

The second plate 5 (FIG. 5) is fixedly bonded to the first plate 2. The second plate 5 has apertures 5*a* that prevent interference with mounting of the recording element substrates 1 and 10.

The sheet electric wiring board 3 is joined to an upper surface of the second plate 5 so as to be electrically connected to the recording element substrates 1 and 10. The sheet electric wiring board 3 is connected to the contact-terminal wiring board 4 by an ACF, lead bonding, wire bonding, or a connector. In the following description, a wiring portion obtained by connecting the sheet electric wiring board 3 and the contact-terminal wiring board 4 will be referred to as an electric wiring portion.

The electric wiring portion applies an electric signal for discharging recording liquid to the recording element substrate 1. The contact-terminal wiring board 4 includes electric wires corresponding to the recording element substrates 1 and 10, and external-signal input and output terminals 4*a* for transmitting and receiving electrical signals from the apparatus body. The contact-terminal wiring board 4 having the external-signal input and output terminals 4*a* is fixed in position to a back side of the flow passage forming member 6.

While the electric wiring portion is divided into the sheet electric wiring board 3 and the contact-terminal wiring board 4 in the first exemplary embodiment, the sheet electric wiring board 3 and the contact-terminal wiring board 4 can be formed by the same member.

The flow passage forming member 6 includes two sections, namely, an upstream-passage forming section 6*a* and a downstream-passage forming section 6*b*. The upstream-passage forming section 6*a* and the downstream-passage forming section 6*b* are joined by a joining method such as ultrasonic welding.

A description will now be given of the porous member (filter) 7 for trapping dust and bubbles in the recording liquid. In the following description, the nozzle arrays 31 and 41 for yellow shown in FIG. 2 will be generically named yellow nozzle arrays 1Y. The nozzle arrays 32, 33, 42, and 43 for magenta will be generically named magenta nozzle arrays 1M. The nozzle arrays 34, 35, 44, and 45 for cyan will be generically named cyan nozzle arrays 1C.

The filter 7 is provided in recording-liquid introducing portions 61*a* (FIGS. 1A to 1D) of the upstream-passage forming section 6*a*. More specifically, filters 7*a* are respectively provided in the recording-liquid introducing portions 61*a* communicating with the yellow nozzle arrays 1Y, the magenta nozzle arrays 1M, and the cyan nozzle arrays 1C. A filter 7*b* is provided in a recording-liquid introducing portion (not shown) communicating with black nozzle arrays 10B. The filters 7*a* and 7*b* are in press contact with supply ports of recording-liquid storage tanks (not shown) so as to trap dust and bubbles in the recording liquid supplied from the recording-liquid storage tanks and to prevent the entry of dust and bubbles.

Figure 3:
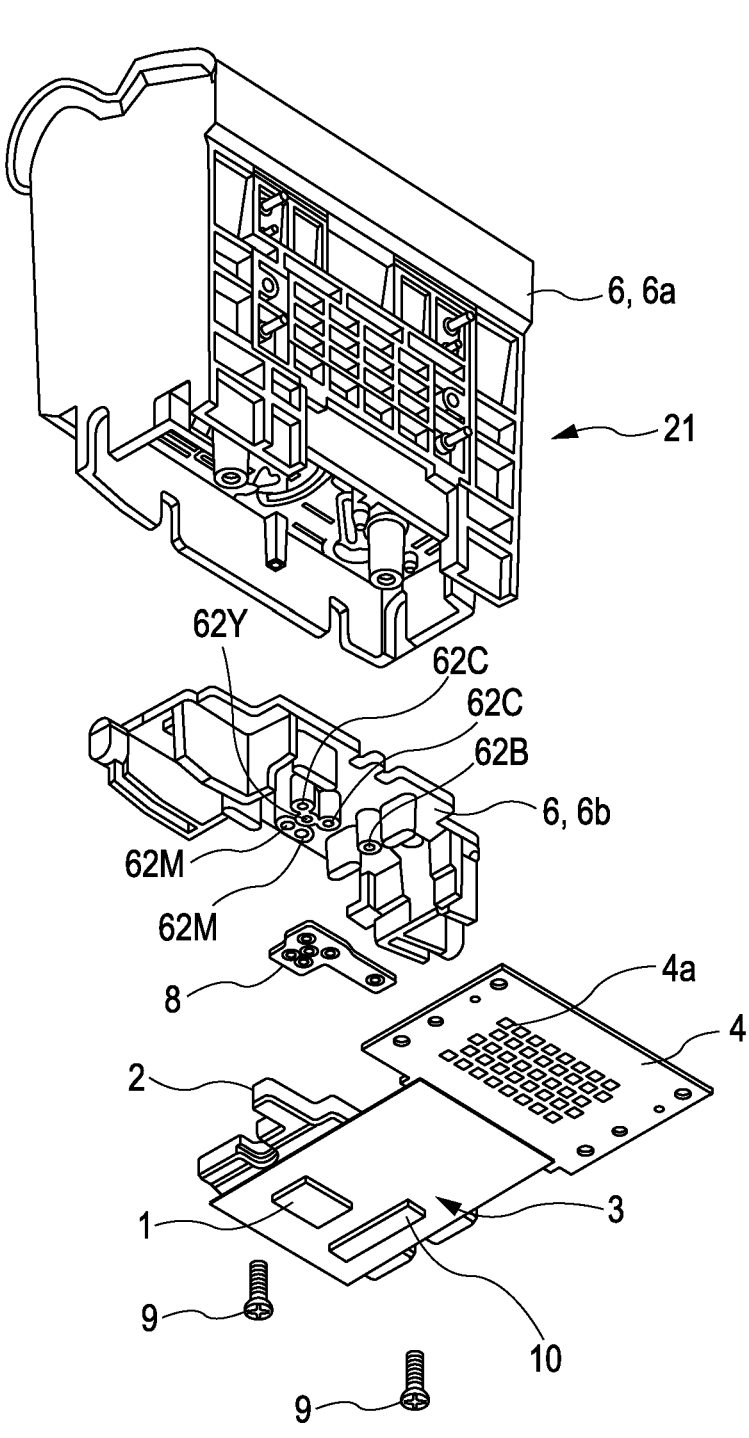
FIG. 3 is an exploded perspective view of a liquid-ejecting recording head.

The seal member 8 shown in FIG. 3 connects the first plate 2 and the downstream-passage forming section 6*b* in a sealed manner, and allows the first plate 2 and the downstream-passage forming section 6*b* to communicate with each other. In general, the seal member 8 is formed of, for example, rubber or an elastomer. The first plate 2 and the downstream-passage forming section 6*b* are completely sealed by fixing the first plate 2 to a sleeve of the upstream-passage forming section 6*a* by the screws 9.

Figure 4:
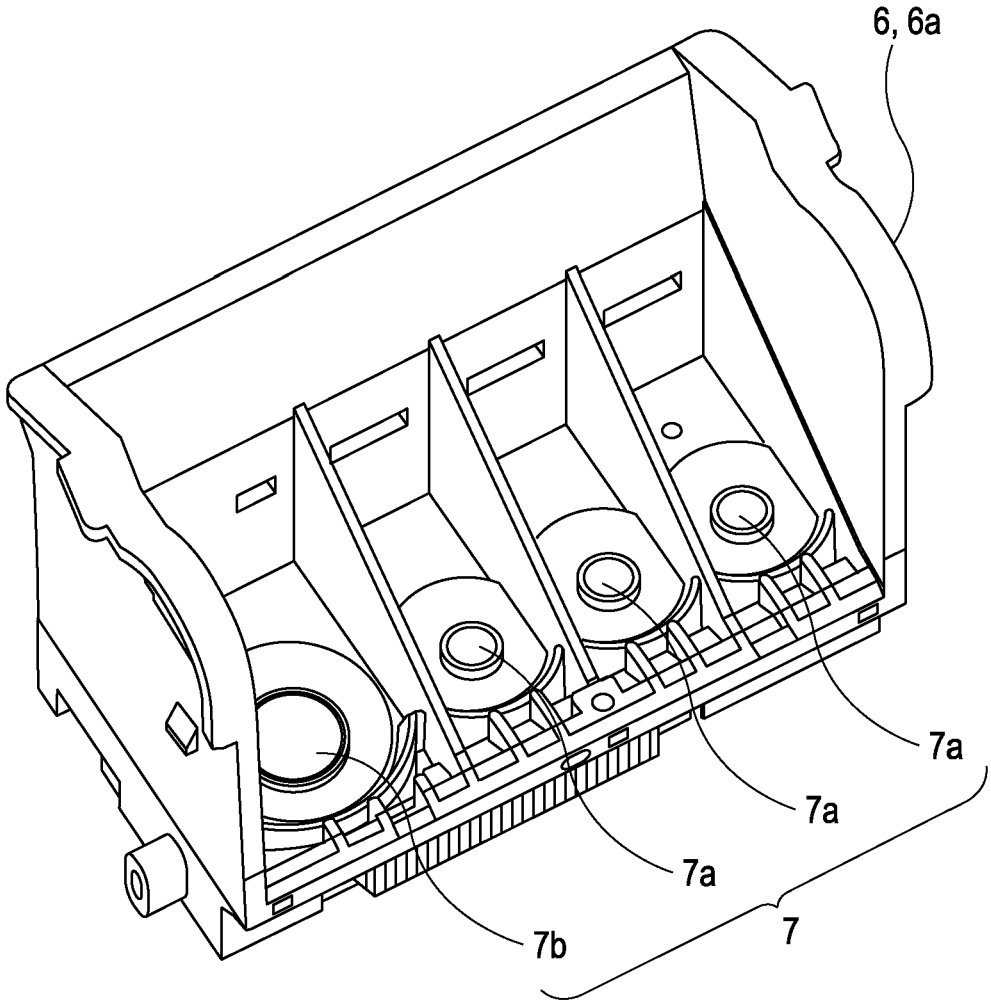
FIG. 4 is an assembly perspective view of the liquid-ejecting recording head.

Therefore, recording liquid supplied from the recording-liquid storage tanks (not shown) mounted in the flow passage forming member 6 flows into recording-liquid introducing passages 61 (FIGS. 1A to 1D) via the filters 7*a* and 7*b* shown in FIG. 4. Subsequently, the recording liquid is supplied to the nozzles of the recording element substrates 1 and 10 via the first plate 2 shown in FIG. 3.

A detailed description will now be given of the surroundings of the recording-liquid introducing portion 61*a* and the filter 7 in the flow passage forming member 6. As shown in FIGS. 1A to 1D, the recording-liquid introducing passage 61 is provided in the cylindrical recording-liquid introducing portion 61*a*. Specifically, a yellow introducing passage 61Y serving as a first recording-liquid introducing passage (FIGS. 1A and 1B), a magenta introducing passage 61M serving as a second recording-liquid introducing passage, a cyan introducing passage 61C serving as a third recording-liquid introducing passage (FIGS. 1C and 1D), and a black introducing passage (not shown) are provided so as to correspond to the kinds of recording liquids.

Figure 1A:
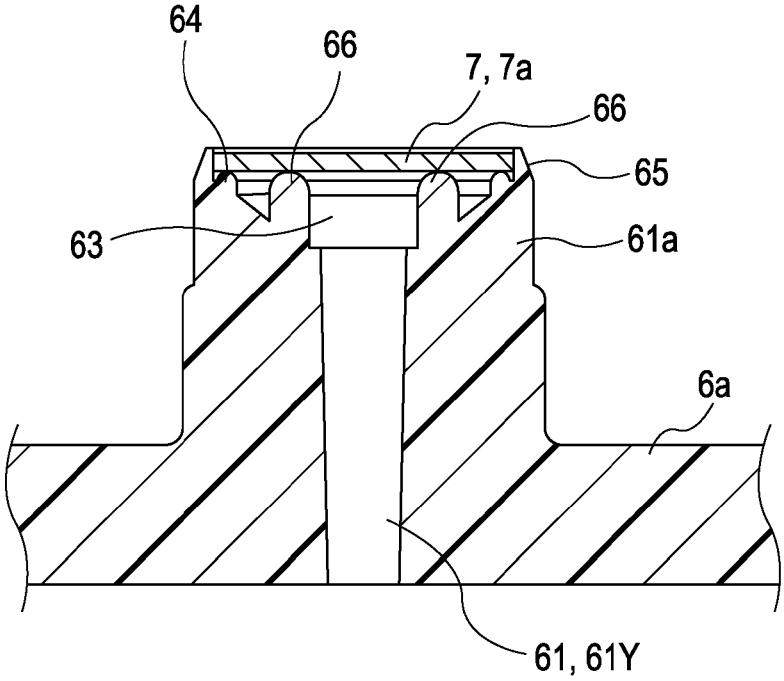
FIG. 1A is a schematic partial cross-sectional view showing a yellow introducing passage and its surroundings before a filter is fixed.
Figure 1B:
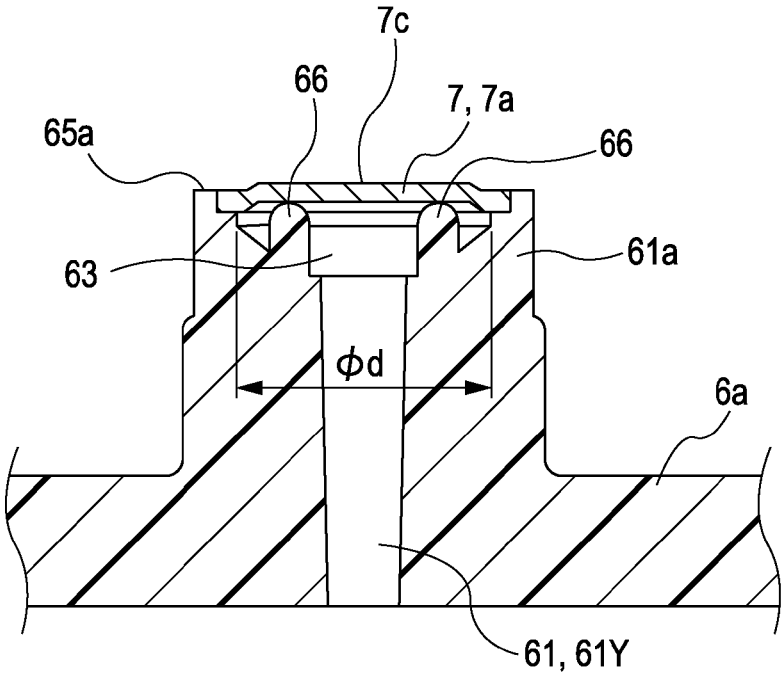
FIG. 1B is a schematic partial cross-sectional view showing the yellow introducing passage and its surroundings after the filter is fixed.

The filter 7 is provided in each recording-liquid introducing passage 61. Specifically, the filter 7 is welded to an entrance (recording-liquid introducing port 63) of each recording-liquid introducing passage 61 by heat. More specifically, an inner rib 64 and an outer rib 65 are provided on the outer periphery of the recording-liquid introducing port 63, and the filter 7 is welded by thermally deforming the inner rib 64 and the outer rib 65. That is, resin of the inner rib 64 melted by heat enters the mesh of the filter 7. On the other hand, resin of the outer rib 65 softened by heat swages and covers the edge of the filter 7 from the outer periphery. As a result, as shown in FIGS. 1B and 1D, the edge of the filter 7 is aligned with the peripheral edge of the recording-liquid introducing port 63. Therefore, the downstream-side (back-side) aperture area of the filter 7*a* provided in the yellow introducing passage 61Y is defined by the diameter ϕd (FIG. 1B) of the opening of the recording-liquid introducing port 63. The downstream aperture area of the filters 7*a* provided in the cyan introducing passage 61C and the magenta introducing passage 61M is defined by the diameter ϕd' (FIG. 1D) of the opening of the recording-liquid introducing ports 63. Further, the downstream aperture area of the filter 7*b* provided in the black introducing passage (not shown) is defined by the diameter of the opening of the recording-liquid introducing port. The upstream aperture areas of the filters 7*a* and 7*b* are the same.

While the downstream aperture areas of a plurality of filters 7 are different in accordance with the kinds of recording liquids passing through the filters 7, the upstream aperture areas thereof are the same, regardless of the kinds of recording liquids.

A plurality of columns 66 stand on the downstream side of the welded filter 7 so as to support the filter 7. In this way, the center of the back side of the filter 7 is supported by the columns 66, and the outer periphery of the filter 7 is covered by swaging. Therefore, the welded filter 7 is curved so as to form a convex portion 7*c* at the center front thereof.

In the next process, the convex portion 7*c* at the center front of the filter 7 is pressed so as to flatten a contact surface of the filter 7 with the recording-liquid storage tank (not shown). As a result, the filter 7 can have a shape that is not obtained by the filter only. That is, the surface of the filter 7 can ensure a good contact state, regardless of the surface hardness of a press contact member of the recording-liquid storage tank. The contact surface between the convex portion 7*c* at the center front of the filter 7 and the press contact member of the recording-liquid storage tank is disposed higher than a swaging face 65*a* provided on the outer periphery of the filter 7.

As described above, the downstream aperture areas of the filters 7*a* and 7*b* are defined by the diameters of the openings of the recording-liquid introducing ports 63 at which the filters are provided. Therefore, the pressure losses of the filters 7*a* and 7*b* can be adjusted by changing the diameters of the openings. The diameters of the openings of the recording-liquid introducing ports 63 can be adjusted by changing the diameters of the inner ribs 64. By thus adjusting the diameters of the openings of the recording-liquid introducing ports 63, the same type of filter can be commonly used in a plurality of recording-liquid introducing passages 61. That is, the relative difference in pressure loss can be reduced by independently adjusting the pressure losses between the recording-liquid introducing ports 63 and the nozzle arrays in the recording-liquid flow passages.

Figure 5A:
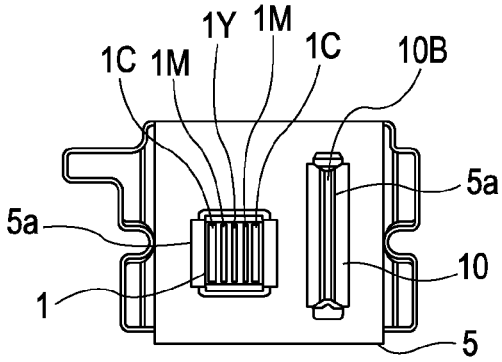
FIGS. 5A to 5D are component views showing the positions of recording-liquid flow passages in the liquid-ejecting recording head.

As shown in FIG. 5A, the color recording element substrate 1 includes a yellow nozzle array 1Y, and two magenta nozzle arrays 1M that are arranged in line symmetry with respect to the yellow nozzle array 1Y. On the outermost sides of the color recording element substrate 1, two cyan nozzle arrays 1C are arranged in line symmetry with respect to the yellow nozzle array 1Y. The black recording element substrate 10 includes a black nozzle array 10B.

Figure 5B:
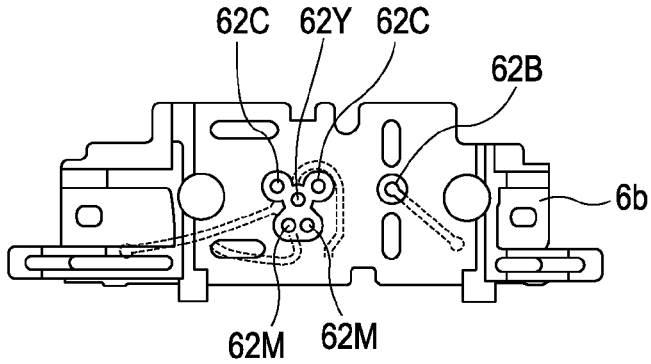

As shown in FIG. 5B, the downstream-passage forming section 6*b* has connecting ports 62C, 62M, 62Y, 62M, 62C, and 62B. The connecting ports 62C, 62M, 62Y, 62M, 62C, and 62B are disposed so as to correspond to the positions of the nozzle arrays 1C, 1M, 1Y, 1M, 1C, and 10B shown in FIG. 5A. The two connecting ports 62C corresponding to the cyan nozzle arrays 1C are arranged in line symmetry with respect to the connecting port 62Y. The two connecting ports 62M corresponding to the magenta nozzle arrays 1M are also arranged in line symmetry with respect to the connecting port 62Y.

Figure 5C:
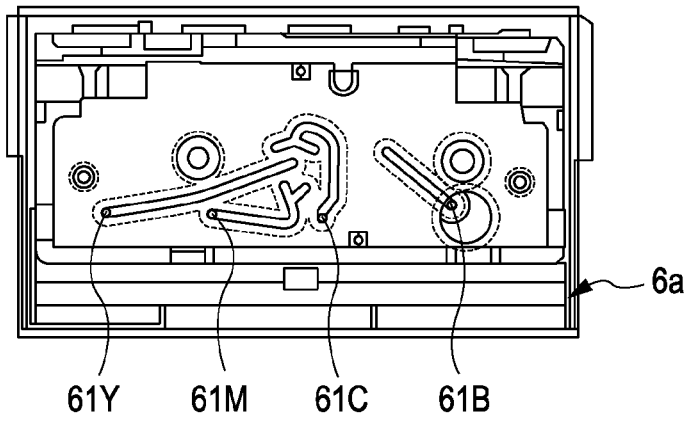
Figure 5D:
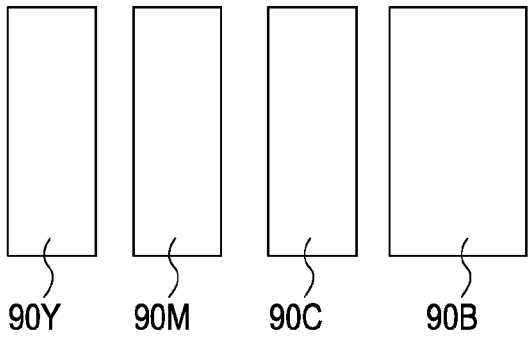
Figure 6:
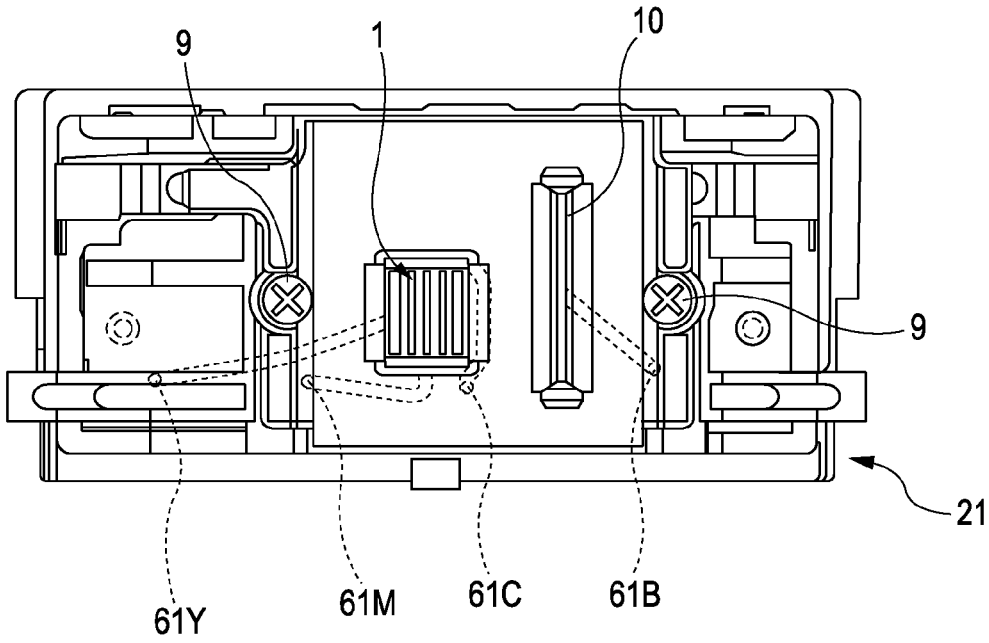
FIG. 6 is a transparent view showing a state in which the components shown in FIGS. 5A to 5C are assembled.

As described above, the upstream-passage forming section 6*a* has the recording-liquid introducing passages 61Y, 61M, 61C, and 61B (FIG. 5C). The recording-liquid introducing passages 61Y, 61M, 61C, and 61B are disposed so as to correspond to the positions of joint portions of recording-liquid storage tanks 90Y, 90M, 90C, and 90B for the colors Y, M, C, and B (FIG. 5D). Recording liquid supplied from the recording-liquid introducing passages 61Y, 61M, 61C, and 61B flows through supply passages (portions shown by dotted lines in FIG. 6), and is supplied to the nozzle arrays 1C, 1M, 1Y, 1C, and 10B shown in FIG. 5A. In this case, one recording-liquid supply passage extends from the recording-liquid introducing passage 61Y corresponding to the yellow tank 90Y to the yellow nozzle array 1Y. Similarly, one recording-liquid supply passage extends for black recording liquid. In contrast, a recording-liquid supply passage extending from the introducing passage 61C corresponding to the cyan tank 90C to the two cyan nozzle arrays 1C is bifurcated into two branches. This also applies to the magenta recording-liquid supply passage. The lengths of the two branches of the recording-liquid supply passage are equal to each other. With the above-described structure, the flow resistance produced by the flow of recording liquid from the recording-liquid storage tank to the nozzle array can be set to be almost the same between the nozzle arrays for the same color. As a result, the recording-liquid discharging characteristic and the ability to remove bubbles from the supply passages can be made the same between the nozzle arrays for the same color.

Figure 7:
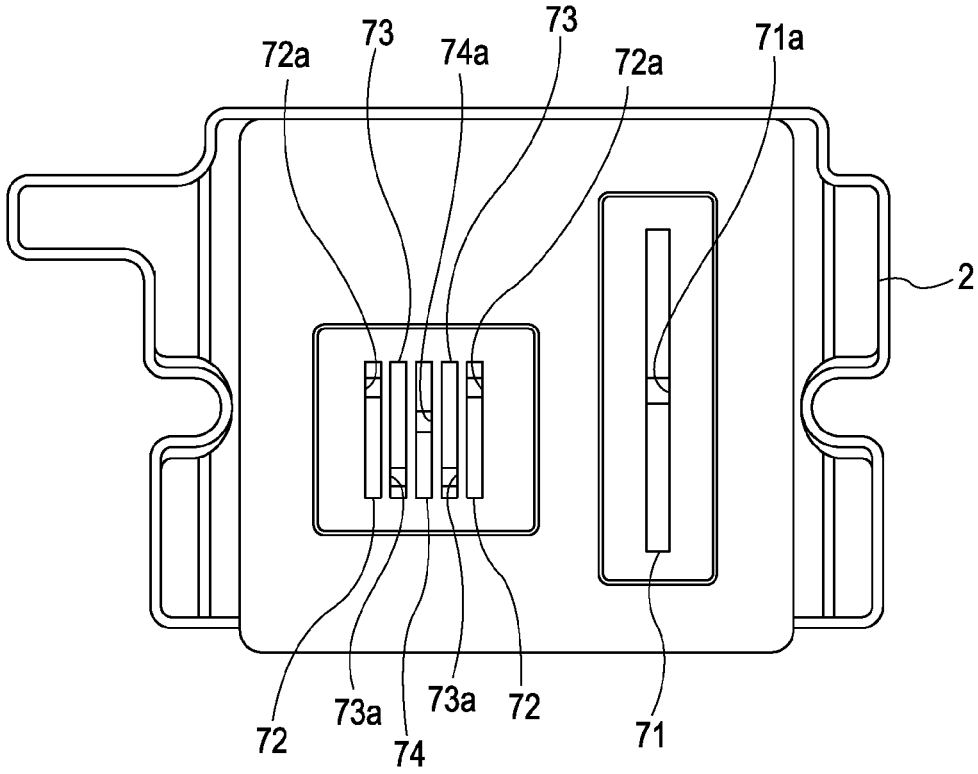
FIG. 7 is a plan view of a support substrate on which the recording element substrates are fixed.

FIG. 7 shows the first plate 2 from which the color recording element substrate 7 and the black recording element substrate 10 are removed. In FIG. 7, a supply groove 71 corresponds to a black common liquid chamber in the black recording element substrate 10. In the supply groove 71, a through hole 71*a* to be connected to the black connecting port 62B (FIG. 5B) is provided. Similarly, a supply groove 72 corresponds to a cyan common liquid chamber in the color recording element substrate 1, a supply groove 73 corresponds to a magenta common liquid chamber, and a supply groove 74 corresponds to a yellow common liquid chamber. Through holes 72*a*, 73*a*, and 74*a* correspond to the cyan connecting port 62C, the magenta connecting port 62M, and the yellow connecting port 62Y shown in FIG. 5B, respectively.

Figure 8:
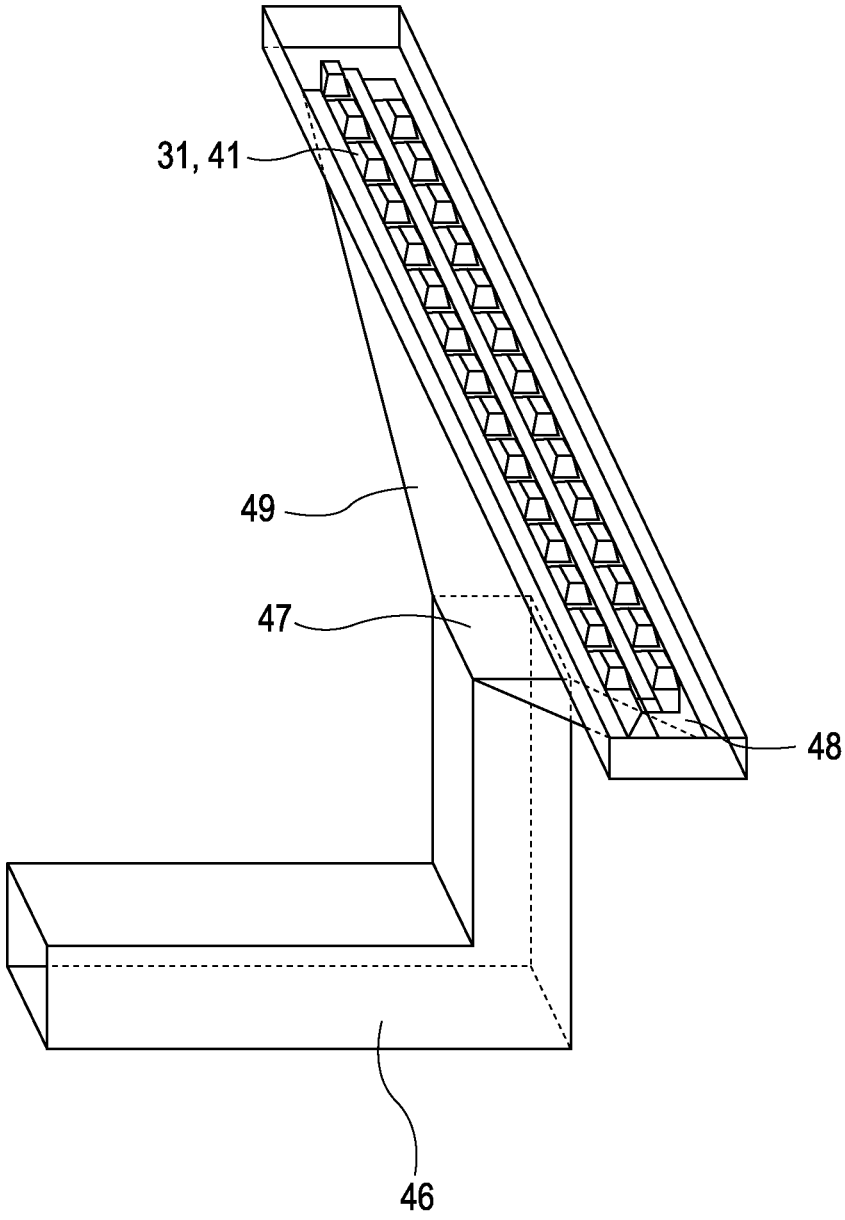
FIG. 8 is a perspective view showing a recording-liquid flow passage extending from one common liquid chamber to a recording-liquid supply passage.
Figure 9:
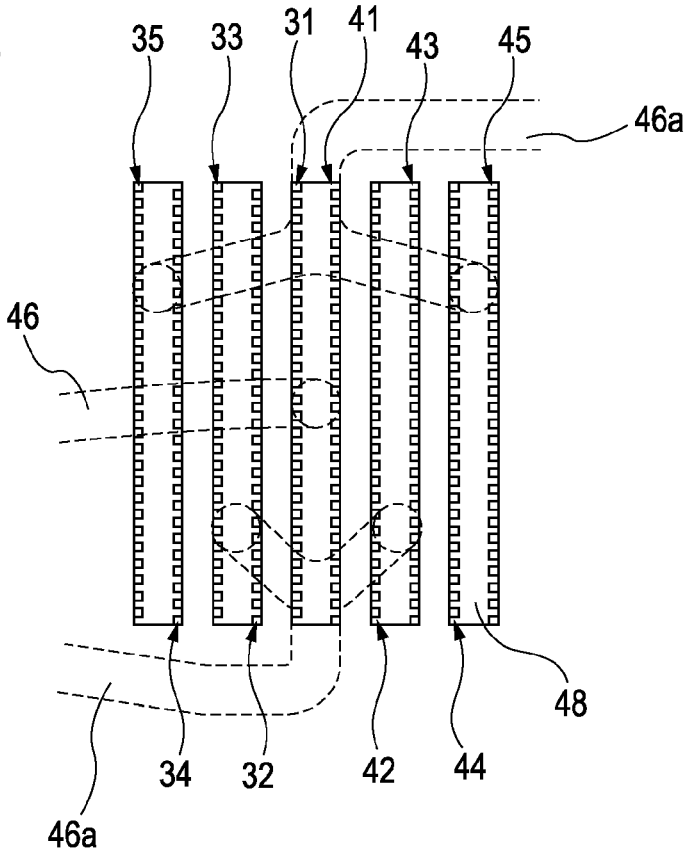
FIG. 9 is a transparent view of the color recording element substrate, as viewed from the support substrate.
Figure 10:
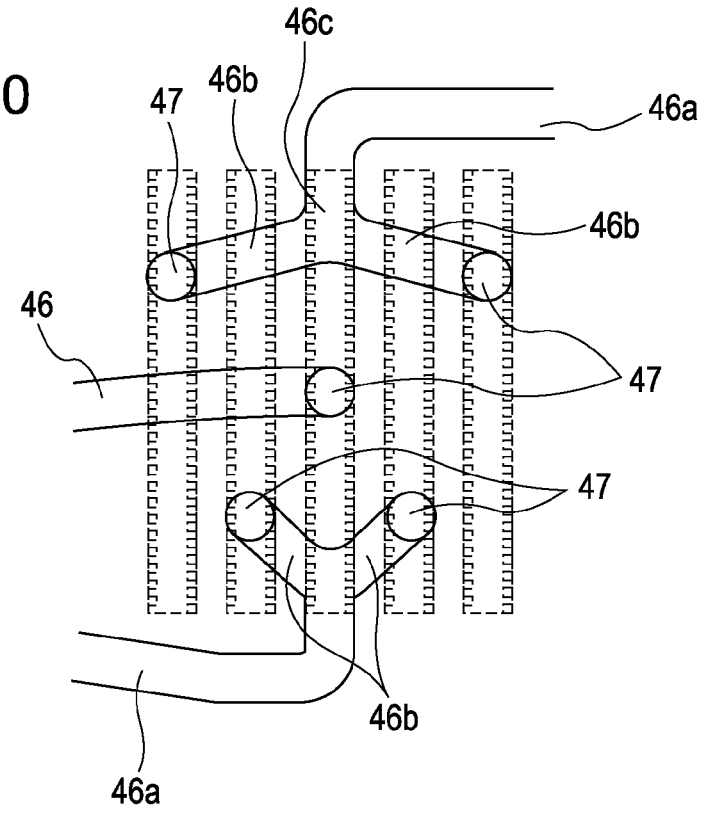
FIG. 10 is a transparent view of nozzle arrays in the color recording element substrate, as viewed from the recording-liquid discharging side.

FIG. 8 shows a general passage structure having one common liquid chamber through which color recording liquid is supplied. Recording liquid supplied from the recording-liquid storage tank (not shown) flows through a supply passage 46. The recording liquid is then introduced into a supply groove 49 serving as a common liquid chamber 48 via a supply-passage connecting port 47. Further, the recording liquid is supplied to the nozzle arrays 31 and 41 via the common liquid chamber 48. In contrast, when recording liquid is supplied through a plurality of common liquid chambers, the supply passage 46 is bifurcated, as shown in FIGS. 9 and 10. The supply passage 46 is bifurcated into individual supply grooves 46*b* via a common supply passage 46*a* and a branching portion 46*c*. Then, the recording liquid is introduced into the supply groove 49 via supply-passage connecting ports 47 corresponding to the nozzle arrays. Subsequently, the recording liquid is supplied to the nozzle arrays 32, 33, 42, and 43, or the nozzle arrays 34, 35, 44, and 45 via the common liquid chamber 48. The independent black supply groove 71 has a single supply-passage structure similar to that of the yellow supply groove 74 provided between the supply grooves arranged symmetrically. In the cyan and magenta supply grooves 72 and 73, two lines connecting one branch portion 46*c* and two supply-passage connecting ports 47 extend in line symmetry with respect to the common supply passage 46*a*.

The individual supply passages 46*b* that supply the same color recording liquid to a plurality of nozzle arrays are equal in capacity and pressure loss so that the ability to remove bubbles remaining in the recording-liquid flow passage is not reduced. Therefore, the discharging characteristic does not vary among the nozzle arrays, bidirectional printing is performed uniformly, and proper suction recovery is possible. Further, the angles formed by the two individual supply passages 46 with the common supply passage 46*a* at the branch portion 46*c* are equally set. This allows the influence of inertia caused by the flow of the recording liquid to be constant in the individual supply passages 46*b*. Further, since the individual supply passages 46*b* are symmetrical with respect to the branch portion 46*c*, the pressure losses of the individual supply passages 46*b* can be made the same.

In this way, the cyan and magenta supply passages are bifurcated, and the yellow supply passage is formed by a single passage. The diameter ϕd' of the openings of the recording-liquid introducing ports 63 communicating with the cyan and magenta supply passages is set at a small value (see FIGS. 1C and 1D).

In contrast, the diameter ϕd of the opening of the recording-liquid introducing port 63 communicating with the yellow supply passage is set at a large value. By this setting, the relative difference in pressure loss among the yellow, cyan, and magenta supply passages can be reduced.

That is, the flow resistance difference caused between the nozzle arrays is reduced, and it is easy to simultaneously suck all nozzle arrays in the color recording element substrate 1 while the nozzle arrays are covered with a single cap. Moreover, the suction recovery performance is improved. Therefore, printing failure will not be caused by bubbles remaining after suction recovery, and recording can be always performed stably. In addition, it is possible to reduce the amount of waste ink and the operating cost.

FIG. 11B shows a suction recovery device 100 serving as a suction unit.

A recovery cap 101 covers all nozzle arrays in the color recording liquid substrate 1. A recovery pump 103 simultaneously sucks the recording liquid from all nozzle arrays in the recording element substrate 1 via a recovery tube 102 and the recovery cap 101. The sucked recording liquid is stored in a waste-liquid treating portion 104.

The filters 7 are formed by members of the same shape, regardless of the diameters ϕd of the openings of the recording-liquid introducing ports 63. This reduces the parts cost and improves productivity.

Resin of the inner rib 64 melted by heat enters the mesh of the filter 7, and defines a downstream aperture of the filter 7. In this way, the diameter ϕd of the opening of the recording-liquid introducing port 63 is formed by combining the inner rib 64 and the filter 7 by welding. Therefore, it is necessary to set a step only of forming the diameter ϕd of the opening of the recording-liquid introducing port 63. This improves production efficiency and reduces the production cost.

Second Exemplary Embodiment

A description will now be given of an application to a liquid-ejecting recording head that discharges droplets having a large volume (hereinafter referred to as large droplets) and droplets having a small volume (hereinafter referred to as small droplets). For example, recording liquids of specific colors (cyan and magenta) are discharged in the form of droplets having a plurality of sizes, and recording liquid of a color (yellow) different from the specific colors is discharged in the form of droplets having the same size. More specifically, a first nozzle array group including a plurality of nozzle arrays having nozzles of different sizes is prepared. Further, a second nozzle array group including nozzle arrays having nozzles that are equal in size to the largest nozzles in the first nozzle array group.

With the above-described nozzle structure, printing can be performed at a higher speed than in the liquid-ejecting recording apparatus that discharges only large droplets. On the other hand, recording can be performed in more gradation levels than in the liquid-ejecting recording apparatus that discharges only small droplets. By appropriately combining large droplets and small droplets, high-speed recording can be performed in a wide range of gradation levels.

A description will be given below of a liquid-ejecting recording head having the above-described nozzle structure according to a second exemplary embodiment of the present invention. The same components as those adopted in the first exemplary embodiment are denoted by the same reference numerals.

Figure 12:
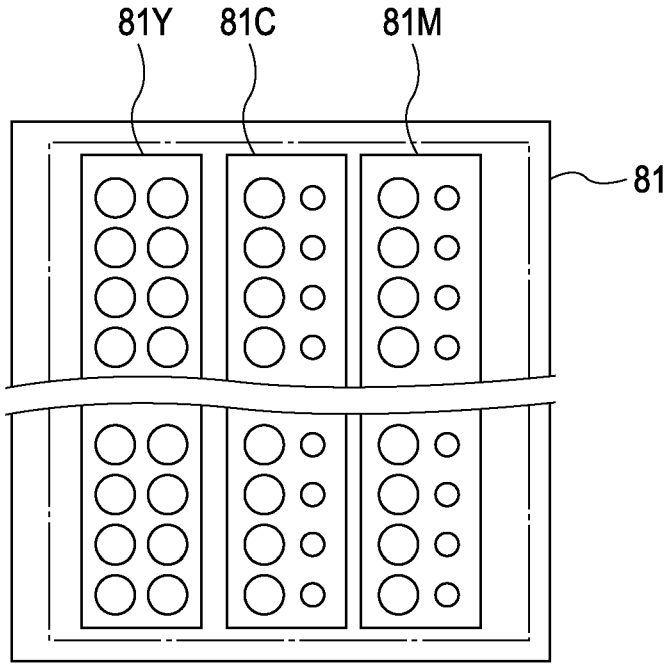
FIG. 12 is a schematic view of a recording element substrate in a liquid-ejecting recording head according to a second exemplary embodiment of the present invention.

In FIG. 12, a recording element substrate 81 includes a yellow nozzle array 81Y, a cyan nozzle array 81C, and a magenta nozzle array 81M. The yellow nozzle array 81Y includes two large droplet nozzle arrays in which a plurality of nozzles having a relatively large size (aperture diameter) (large droplets nozzles) are arranged. The cyan nozzle array 81C, and the magenta nozzle array 81M each include a large droplet nozzle array having a plurality of large droplet nozzles, and a small droplet nozzle array having a plurality of nozzles having a relatively small size (aperture diameter) (small droplet nozzles). That is, the yellow nozzle array 81Y corresponds to the above-described second nozzle array group, and the cyan nozzle array 81C and the magenta nozzle array 81M correspond to the above-described first nozzle array group. The large droplet nozzles in the cyan nozzle array 81C and the magenta nozzle array 81M correspond to the largest nozzles in the nozzle arrays of the first nozzle array group. In other words, the yellow nozzle array 81Y includes only the largest droplet nozzles.

Figure 1C:
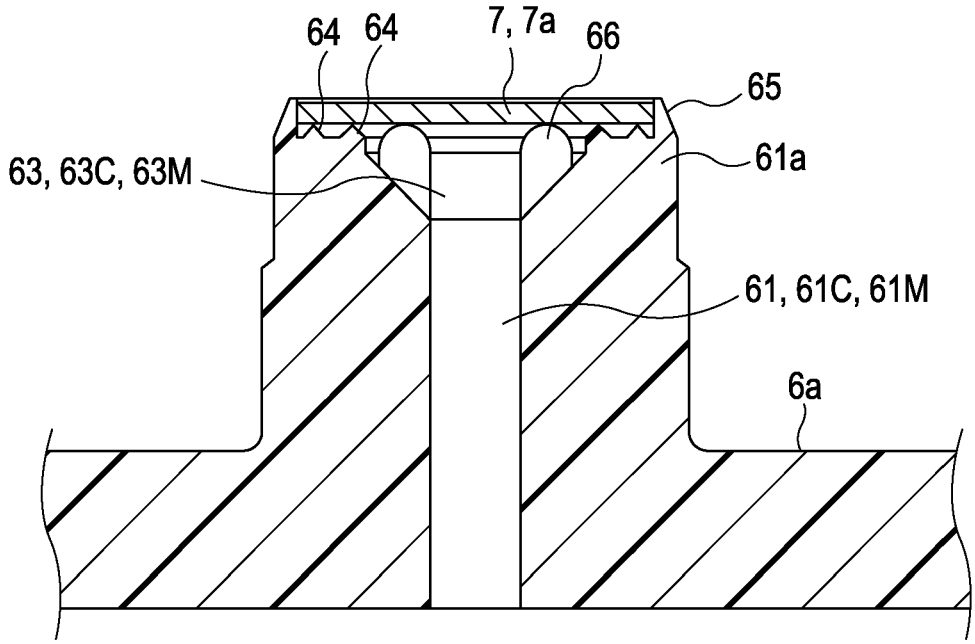
FIG. 1C is a schematic partial cross-sectional view showing a cyan or magenta introducing passage and its surroundings before a filter is fixed.
Figure 1D:
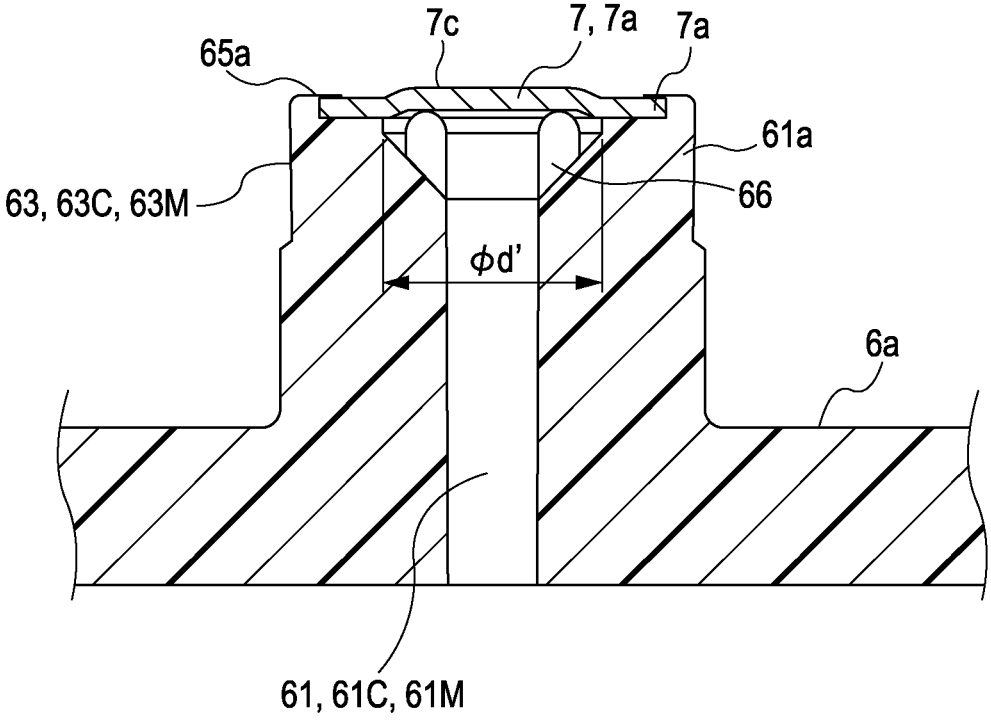
FIG. 1D is a schematic partial cross-sectional view showing the cyan or magenta introducing passage and its surroundings after the filter is fixed.

Accordingly, the opening diameter ϕd' of the recording-liquid introducing portions 63 communicating with the cyan supply passage and the magenta supply passage is set at a large value (FIGS. 1C and 1D). In contrast, the opening diameter ϕd of the recording-liquid introducing portion 63 communicating with the yellow supply passage is set at a small value. That is, the diameter ϕd' is more than the diameter ϕd. This structure can reduce the relative difference in pressure loss among the yellow supply passage, the cyan supply passage, and the magenta supply passage. Therefore, it is easy to simultaneously suck a plurality of nozzle arrays that are covered with a single cap. Moreover, the suction recovery performance is enhanced.

Third Exemplary Embodiment

A liquid-ejecting recording head according to a third exemplary embodiment of the present invention will be described below. The same components as those adopted in the second exemplary embodiment are the same reference numerals.

Figure 13:
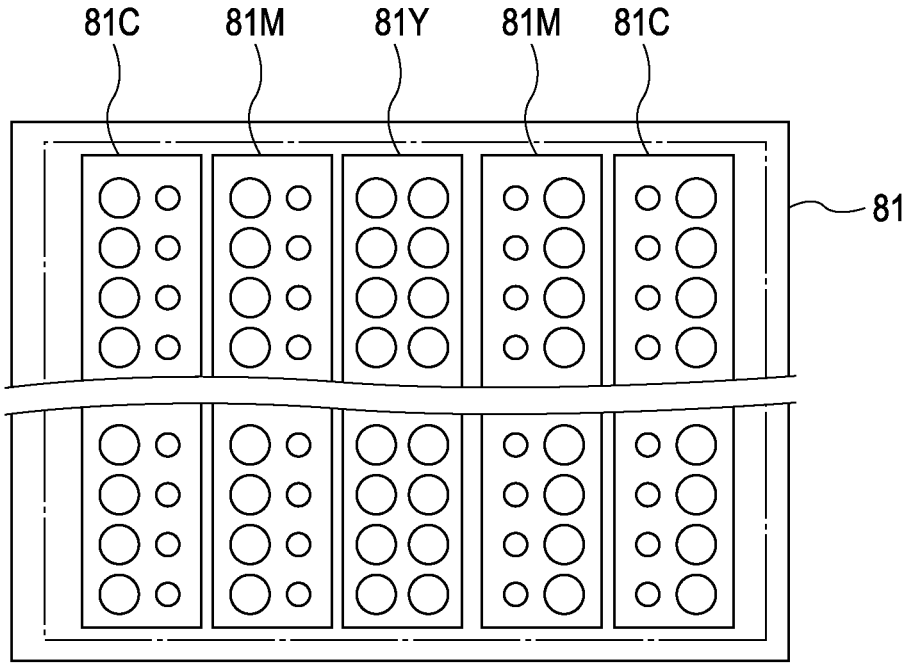
FIG. 13 is a schematic view of a recording element substrate in a liquid-ejecting recording head according to a third exemplary embodiment of the present invention.
Figure 14A:
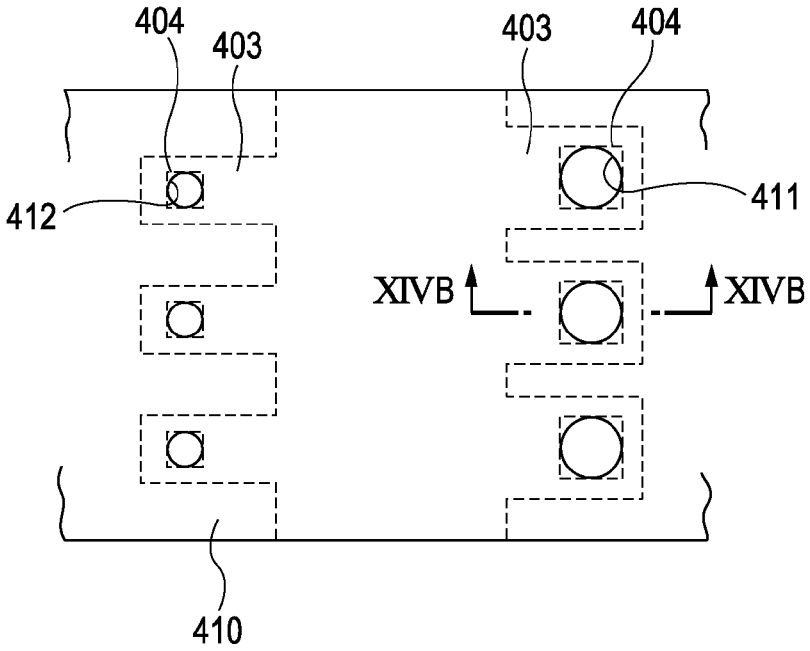
FIGS. 14A and 14B are detailed partial views of nozzle arrays in a liquid-ejecting recording head as the related art.
Figure 14B:
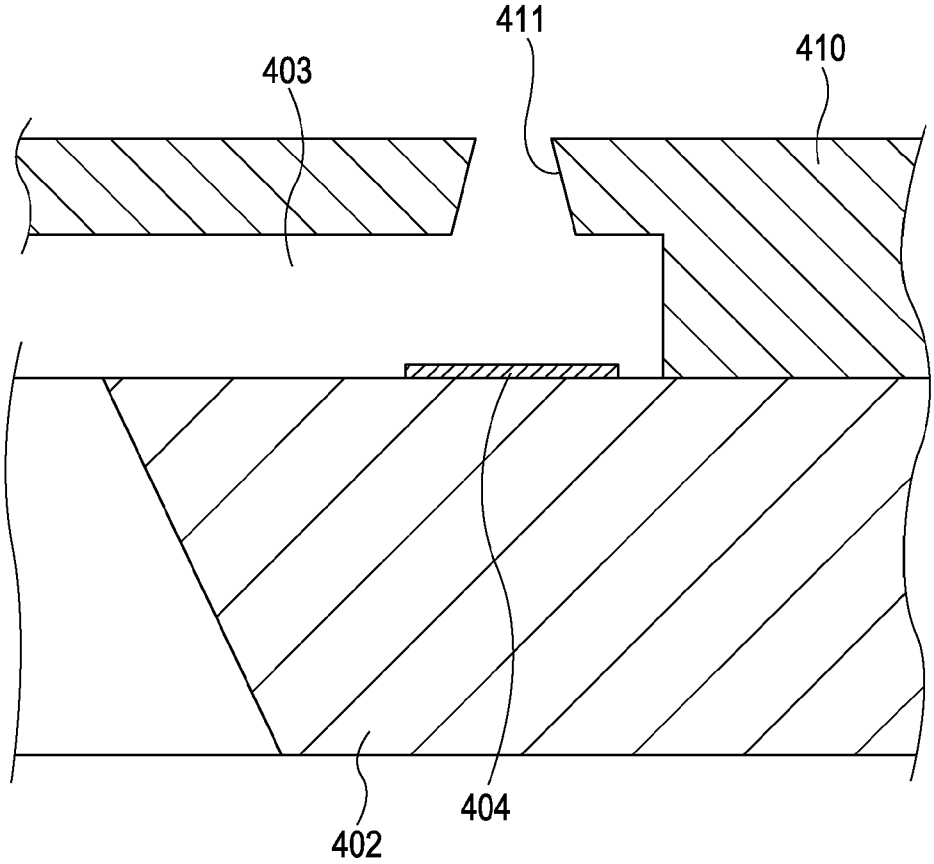
Figure 15:
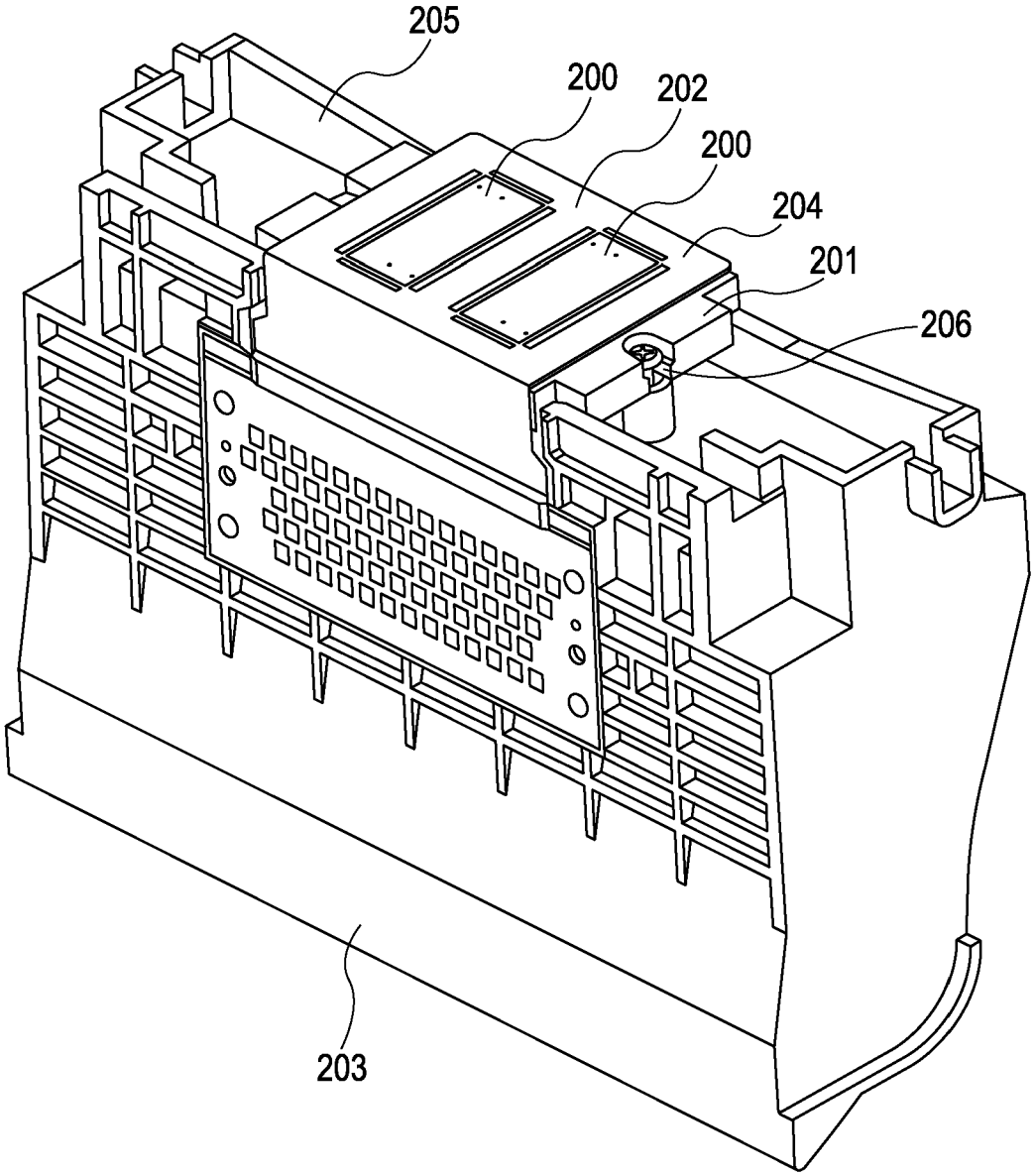
FIG. 15 is a schematic perspective view of a liquid-ejecting recording read in the related art.
Figure 16A:
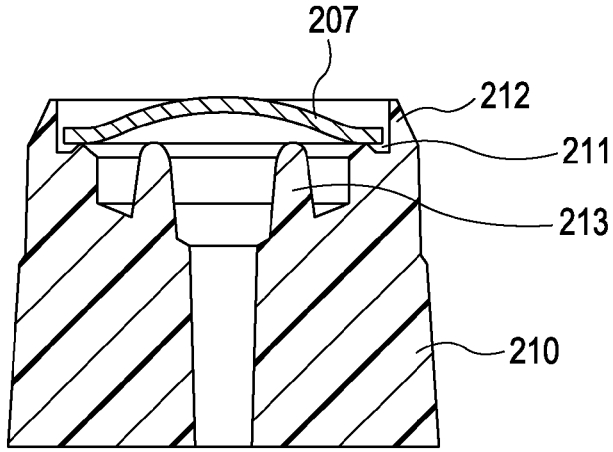
FIGS. 16A to 16C are schematic partial cross-sectional views showing a method for fixing a porous member in the liquid-ejecting recording head in the related art.
Figure 16B:
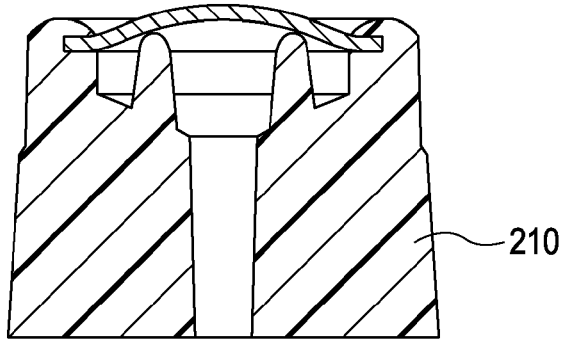
Figure 16C:
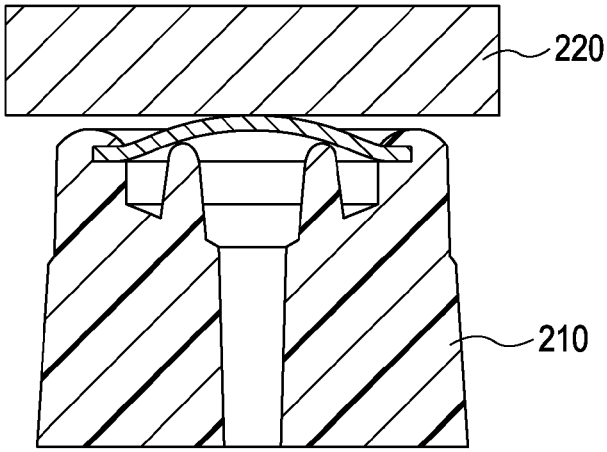

As shown in FIG. 13, in the liquid-ejecting recording head according to the third exemplary embodiment, two cyan nozzle arrays 81C and two magenta nozzle arrays 81M are symmetrically arranged with respect to a yellow nozzle array 81Y. The yellow nozzle array 81Y includes two large droplet nozzle arrays. Each of the cyan nozzle arrays 81C and the magenta nozzle arrays 81M includes a large droplet nozzle array and a small droplet nozzle array.

Accordingly, the opening diameter ϕd of the recording-liquid introducing portion communicating with the yellow supply passage is set to be larger than the opening diameter ϕd' of the recording-liquid introducing passages communicating with the cyan supply passage and the magenta supply passage. That is, ϕd>ϕd'. This can reduce the relative difference in pressure loss among the yellow supply passage, the cyan supply passage, and the magenta supply passage. Therefore, it is easy to simultaneously suck a plurality of nozzle arrays that are covered with a single cap. Moreover, the suction recovery performance is enhanced.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-111779 filed Apr. 20, 2007, which is hereby incorporated by reference herein in its entirety.

What is claimed is:

1. A recording head comprising:

a plurality of first discharging ports configured to discharge first recording liquid;

a plurality of second discharging ports configured to discharge second recording liquid, wherein a total area of the plurality of second discharging ports is larger than a total area of the plurality of first discharging ports;

a first recording-liquid flow passage configured to supply the first recording liquid to the plurality of first discharging ports;

a second recording-liquid flow passage configured to supply the second recording liquid to the plurality of second discharging ports, wherein an area of a second flow passage entrance opening of the second recording-liquid flow passage is smaller than an area of a first flow passage entrance opening of the first recording-liquid flow passage;

a first filter provided at the first flow passage entrance opening and joined to a periphery of the first flow passage entrance opening; and a second filter provided at the second flow passage entrance opening and joined to a periphery of the second flow passage entrance opening, wherein a size of the first filter and a size of the second filter are same, and wherein an area of a joined portion of the second filter to the periphery of the second flow passage entrance opening is larger than an area of a joined portion of the first filter to the periphery of the first flow passage entrance opening.

2. The recording head according to claim 1, wherein a number of the plurality of second discharging ports is larger than a number of the plurality of first discharging ports.

3. The recording head according to claim 1, wherein a number of second discharging port arrays consisted of the plurality of second discharging ports is larger than a number of first discharging port arrays consisted of the plurality of first discharging ports.

4. The recording head according to claim 1, wherein the plurality of first discharging ports include a discharging port array consisting of a plurality of discharging ports having areas that are smaller than areas of the plurality of second discharging ports.

5. The recording head according to claim 1, wherein an area of the first filter upstream in a flowing direction of the first recording liquid is same as an area of the second filter upstream in a flowing direction of the second recording liquid.

6. The recording head according to claim 1, wherein the first flow passage entrance opening is connected to supply ports of a first recording-liquid storage portion and the second flow passage entrance opening is connected to supply ports of a second recording-liquid storage portion.

7. A recording apparatus comprising:

the recording head according to claim 1; and a suction unit including a cap configured to cap the plurality of first discharging ports and the plurality of second discharging ports, wherein the suction unit is configured to suck first recording liquid from the plurality of first discharging ports and second recording liquid from the plurality of second discharging ports through the cap.

8. The recording head according to claim 3, wherein the second recording-liquid flow passage has a branching portion.

9. The recording head according to claim 1, wherein the plurality of first discharging ports are part of a first discharging port array pair bisected by a line of symmetry and the plurality of second discharging ports are part of a second discharging port array pair and a third discharging port array pair positioned symmetrical about the line of symmetry with the second discharging port array pair so that the first discharging port array pair resides between the second discharging port array pair and the third discharging port array pair.

* * * * *